US007152995B2

(12) United States Patent
Chapman

(10) Patent No.: US 7,152,995 B2
(45) Date of Patent: Dec. 26, 2006

(54) FLASHLIGHT

(75) Inventor: Leonard T. Chapman, North Hollywood, CA (US)

(73) Assignee: Chapman/Leonard Enterprises, Inc., North Hollywood, CA (US)

( * ) Notice: Subject to any disclaimer, the term of this patent is extended or adjusted under 35 U.S.C. 154(b) by 72 days.

(21) Appl. No.: 11/016,041

(22) Filed: Dec. 16, 2004

(65) Prior Publication Data

US 2005/0099805 A1 May 12, 2005

Related U.S. Application Data

(63) Continuation-in-part of application No. 10/922,813, filed on Aug. 19, 2004, which is a continuation-in-part of application No. 10/644,392, filed on Aug. 19, 2003, which is a continuation-in-part of application No. 10/397,766, filed on Mar. 25, 2003.

(51) Int. Cl.
*F21L 4/04* (2006.01)

(52) U.S. Cl. ..... 362/206; 362/205; 362/802

(58) Field of Classification Search ..... 362/205, 362/206, 802

See application file for complete search history.

(56) References Cited

U.S. PATENT DOCUMENTS

| | | | |
|---|---|---|---|
| 1,478,282 | A | 12/1923 | Hunter |
| 1,518,575 | A | 12/1924 | Eaton |
| 1,591,627 | A | 7/1926 | Hopkins |
| 1,595,146 | A | 8/1926 | Ford |
| 1,603,272 | A | 10/1926 | Eaton |
| 2,215,900 | A | 9/1940 | Bitner |
| 2,249,689 | A | 7/1941 | Gelardin |
| 2,313,356 | A | 3/1943 | New |
| 2,347,532 | A | 4/1944 | Yardeny |
| 2,435,689 | A | 2/1948 | McCabe |
| 3,535,282 | A | 10/1970 | Mallory |
| 3,800,136 | A | 3/1974 | Edelson |
| 4,546,416 | A | 10/1985 | Pemberton |
| 4,577,263 | A | 3/1986 | Maglica |
| 4,605,994 | A | 8/1986 | Krieg |
| 4,623,957 | A | 11/1986 | Moore et al. |

(Continued)

FOREIGN PATENT DOCUMENTS

| | | |
|---|---|---|
| GB | 2216998 | 10/1989 |

OTHER PUBLICATIONS

Combined International Search Report and Written Opinion of the International Searching Authority for International Application No. PCT/US2005/28831, dated Mar. 14, 2006.

(Continued)

*Primary Examiner*—Sandra O'Shea
*Assistant Examiner*—James W Cranson, Jr.
(74) *Attorney, Agent, or Firm*—Perkins Coie LLP

(57) ABSTRACT

A flashlight has a lens or lenses moveable relative to one or more LED or other light source. The beam of light provided by the LED can be focused and provides a uniform light pattern across the range of focus. The lenses are supported on a front housing section and the LED is supported on a back housing section threaded onto the front housing section. Twisting the front housing section closes a switch providing power to the LED, to turn the flashlight on. One or more circuit modules within the flashlight provides various operating modes including an automatic shut-off timer, to preserve battery life, a dimmer controlled by turning an end cap, a blinking function, a momentary bright function, and/or a current control function to provide maximum brightness regardless of battery condition.

6 Claims, 29 Drawing Sheets

U.S. PATENT DOCUMENTS 4,875,147 A 10/1989 Auer
4,947,291 A * 8/1990 McDermott ..... 362/19
5,138,538 A 8/1992 Sperling
5,351,330 A 9/1994 Jongewaard
5,422,798 A 6/1995 Osiecki et al.
5,594,433 A 1/1997 Terlep
5,630,661 A 5/1997 Fox
5,838,024 A 11/1998 Masuda et al.
5,865,529 A 2/1999 Yan
6,007,218 A 12/1999 German et al.
6,013,985 A 1/2000 Green et al.
6,056,415 A 5/2000 Allred
6,086,220 A 7/2000 Lash et al.
6,095,661 A 8/2000 Lebens et al.
6,142,650 A 11/2000 Brown et al.
6,220,719 B1 4/2001 Vetorino et al.
6,249,089 B1 6/2001 Bruwer
6,296,367 B1 10/2001 Parsons et al.
6,345,464 B1 2/2002 Kim et al.
6,394,630 B1 5/2002 Skidmore et al.
6,398,383 B1 6/2002 Huang
6,485,160 B1 11/2002 Sommers et al.
RE38,014 E 3/2003 Bieberstein
6,527,419 B1 3/2003 Galli
6,536,912 B1 3/2003 Parker
6,612,714 B1 9/2003 Morre et al.
6,642,667 B1 11/2003 Avis
6,736,531 B1 5/2004 Wallach
6,761,467 B1 7/2004 Matthews et al.
6,767,110 B1 7/2004 Cooper et al.
6,793,366 B1 9/2004 Chun
6,802,620 B1 10/2004 Galli
6,841,941 B1 1/2005 Kim et al.
6,854,859 B1 2/2005 Cooper et al.
6,866,401 B1 3/2005 Sommers et al.
6,957,897 B1 10/2005 Nelson
2002/0067608 A1 6/2002 Kruse et al.
2002/0093818 A1 7/2002 Mele
2003/0123254 A1 7/2003 Brass et al.
2003/0133286 A1* 7/2003 Kim ..... 362/110
2004/0130892 A1 7/2004 Galli
2004/0140771 A1 7/2004 Kim et al.
2004/0240201 A1 12/2004 Rausseck
2005/0122714 A1* 6/2005 Matthews et al. ..... 362/206
2005/0157492 A1 7/2005 Chui

OTHER PUBLICATIONS

Combined International Search Report and Written Opinion of the International Searching Authority for International Application No. PCT/US2004/08472, dated Sep. 23, 2005.

Mag-lite Brochure: Anatomy—Mini Maglite. (Jan. 1, 2001).

AvShop Brochure: LED Flashlight with Magnifier Lens. Web Archive.org (May 25, 2002).

* cited by examiner

Fig. 7
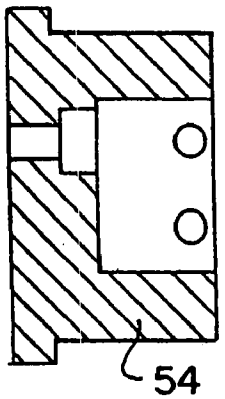
Fig. 6
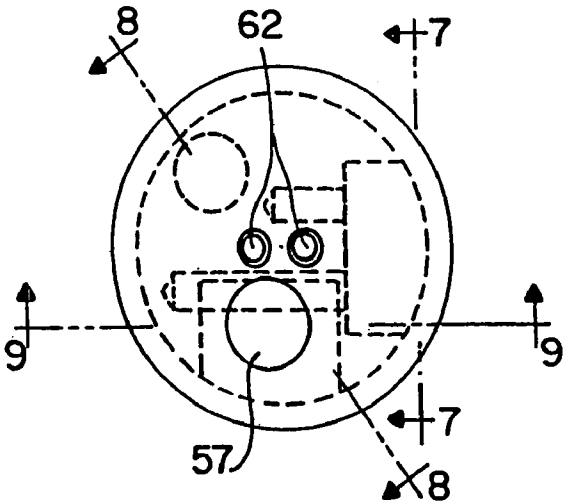
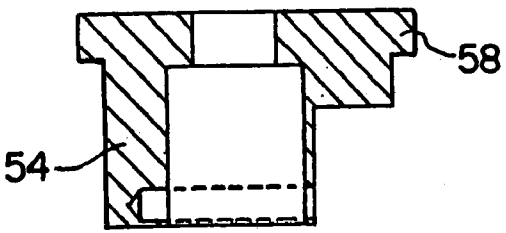
Fig. 9
Fig. 8
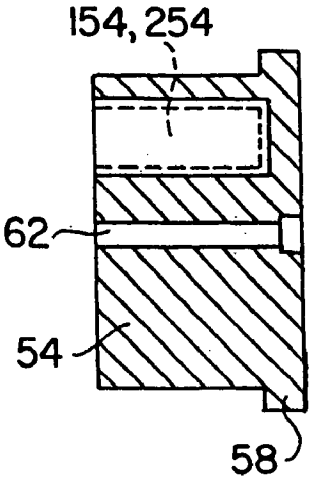

308

340
338
341
27
A
A
27

334
338
341
336

334

342
308
332
330

340

382
384

384
382

368
376
378
376
375

378
368

FLASHLIGHT

This application is a Continuation-in-Part of U.S. patent application Ser. No. 10/922,813, filed Aug. 19, 2004 and now pending, which is a Continuation-In-Part of U.S. patent application Ser. No. 10/644,392, filed Aug. 19, 2003, now pending, which is a Continuation-In-Part of U.S. patent application Ser. No. 10/397,766, filed Mar. 25, 2003, now pending. Priority to each of these applications is claimed under 35 U.S.C. § 120. These applications are also incorporated herein by reference.

BACKGROUND OF THE INVENTION

The field of the invention is flashlights. More specifically, the invention relates to a portable hand held battery powered flashlight.

For many years, flashlights have used batteries, specifically, dry cells, to power an incandescent bulb. Reflectors around or behind the bulb have been provided to help direct light from the bulb. More recently, with the development of light emitting diodes (LED's), in some flashlights the incandescent bulb has been replaced by an LED. Use of an LED in place of an incandescent bulb as a light source in a flashlight has several advantages. Initially, LED's use less power than incandescent bulbs. As a result, battery life in an LED flashlights can be greatly extended. In addition, LED's are manufactured with specific light emission directivity. Unlike an incandescent bulb, which radiates light in all directions, LED's emit light in specific directions, or within a specific angle. Accordingly, for spot illumination, which is the most common use for flashlights, the directivity of LED's is advantageous. LED's also have an operating life which is far longer than that of most incandescent bulbs. Consequently, the disadvantages of bulb burnout or failure, and the need to replace bulbs relatively frequently, are largely avoided.

While use of LED's in flashlights have several advantages, design challenges remain. In particular, the ability to achieve a uniform beam of light under a wide range of conditions has yet to be achieved with existing flashlights, regardless of whether the light source is an LED, an incandescent bulb or another light source. The directivity (included angle) of existing LEDs is not sufficiently narrow for lighting distant from the flashlight. Even with the most directional LEDs, having a directivity angle of about 15°, the emitted light becomes very faint more than one or two meters away from the LED. For various reasons, the light beam of virtually all flashlights is not uniform. The intensity of light in the beam varies. Generally, this variation appears as lighter and darker areas of the beam. Some flashlights produce a beam having an irregular shape, and decreased lighting efficiency, rather than a nearly perfect circle of uniform light.

In the past, several flashlights, especially flashlights having incandescent bulbs, have included beam focusing features. In these types of flashlights, typically a reflector behind or surrounding the bulb is moved relative to the bulb, to change the light beam pattern or to focus the beam. While beam focusing is a useful feature in these types of flashlights, generally, the shape or uniformity of the beam changes as the beam is focused. These types of flashlights are unable to maintain uniform light beam quality over an entire range of focus. As a result, the light beam typically has dark spots and appears dimmer, and the quality of the light beam, in terms of field of illumination, is degraded.

Another drawback with battery powered flashlights is of course the limited life of batteries. While use of LED's can greatly extend battery life, the traditional drawbacks associated with batteries have not been fully overcome. Even with LED flashlights, prolonged use will drain the batteries. Most flashlights have an on/off switch as the only control. This often results in compromises in performance, since when the flashlight in on, the bulb or LED is illuminated using whatever power may remain in the batteries. If the light output is not sufficient, the only thing the user can do is to put in fresh batteries. In many uses, a relatively low amount of light is ordinary sufficient, and a brighter light is only needed intermittently, for short time intervals. However, even with the advent of LED flashlights, these types of needs are not well met with existing designs.

Accordingly, it is an object of the invention to provide an improved flashlight.

SUMMARY OF THE INVENTION

A flashlight has a first or an on/off switch. When the first switch is on or closed, a circuit allows a first amount of current flow to a bulb or LED, which creates a first amount of light. The circuit is designed so that the first amount of current can be delivered for a relatively longer amount of time, before the batteries run down. The flashlight also has a second or a momentary bright switch. When the first switch is on, and when the momentary bright switch is actuated, the circuit allows a second and larger amount of current to flow to the bulb or LED. This provides increased light output, while the momentary bright switch is actuated or pressed. When the momentary bright switch is released, the circuit returns to providing the first and lower amount of current. As a result, in ordinary use, the flashlight has long battery life. However, the flashlight can also provide a brighter light, when needed, via the momentary bright switch.

Other further objects and advantages will appear from the following written description taken with the drawings, which show several embodiments. However, the drawings and written description are intended as preferred examples, and not as limitations on the scope of the invention. The invention resides as well as sub combinations of the elements described. Each of the separate aspects described above may be used alone, in combination with each other. The features, elements and methods described relative to one embodiment may also be used in the other embodiments.

BRIEF DESCRIPTION OF THE DRAWINGS

In the drawings, wherein the same element number indicates the same element in each of the views;

FIG. 6 is a top view of the switch housing shown in FIGS. 3–5.

FIG. 7 is a section view taken along line 7—7 of FIG. 6.

FIG. 8 is a section view taken along line 8—8 of FIG. 6.

FIG. 9 is a section view taken along line 9—9 of FIG. 6.

DETAILED OF DESCRIPTION OF THE DRAWINGS

Figure 1:
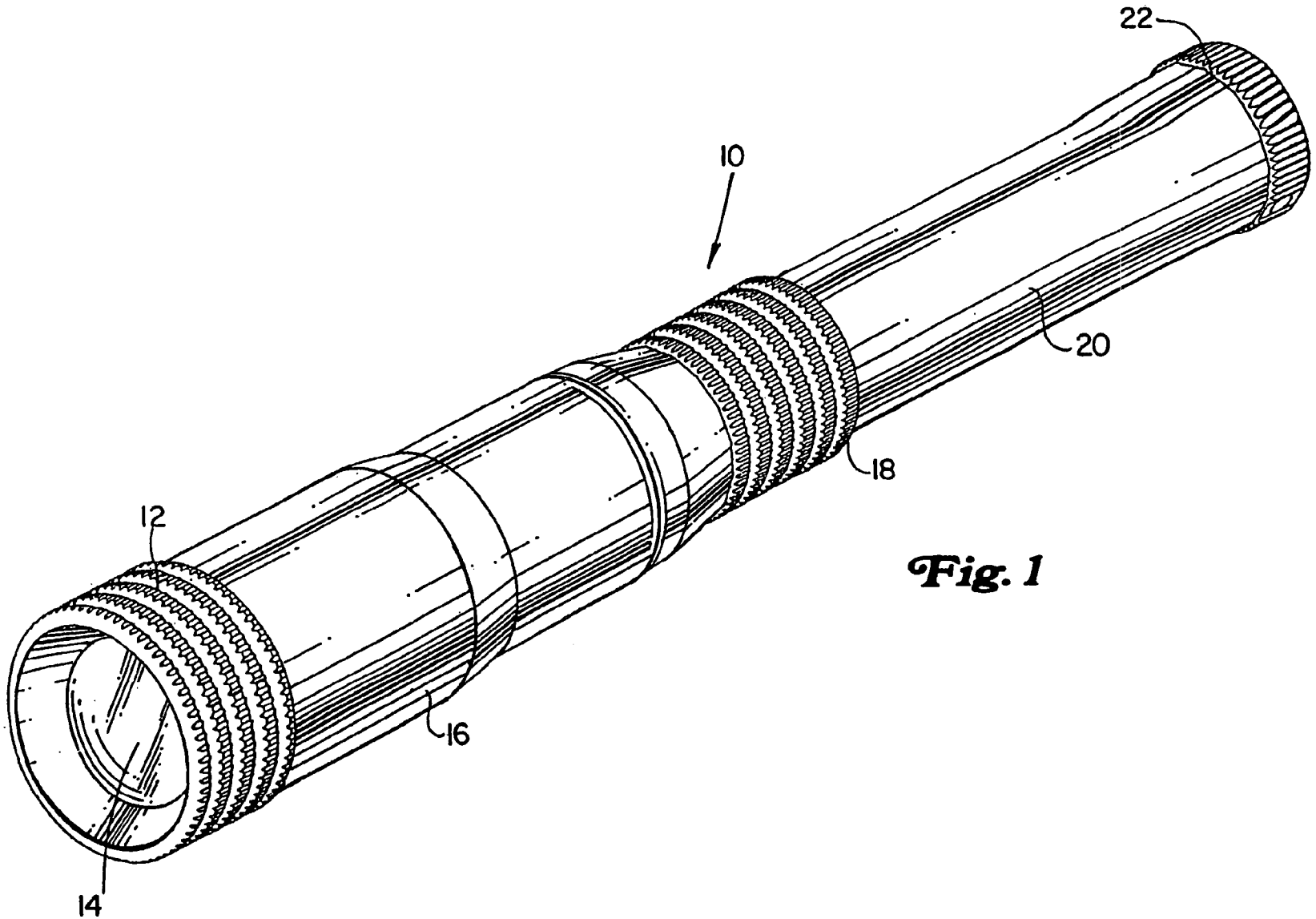
FIG. 1 is a front and side perspective view of the present flashlight.
Figure 2:
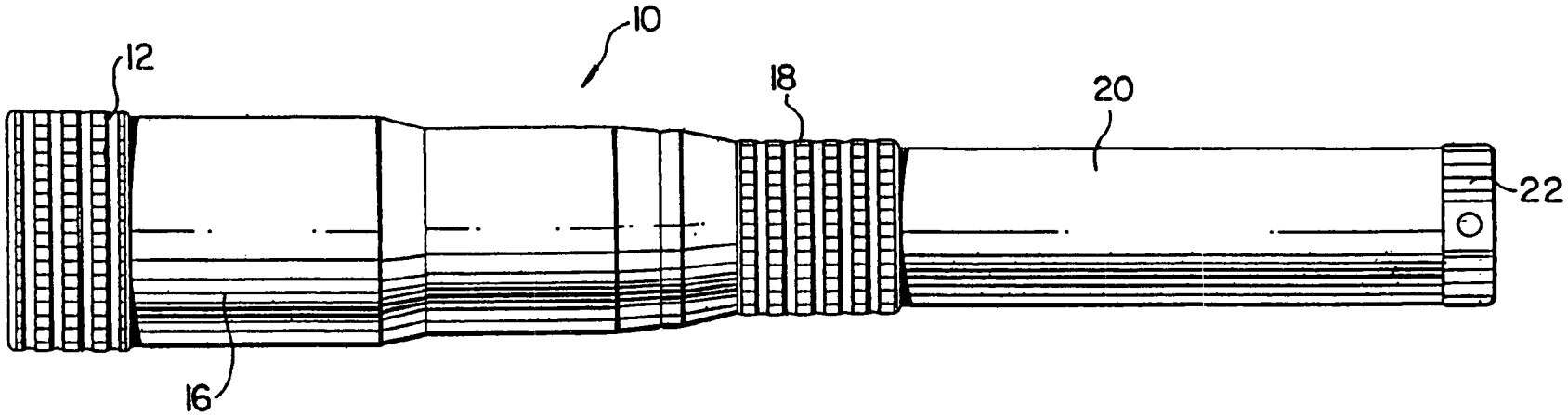
FIG. 2 is a side view of the flashlight shown in FIG. 1.

Turning now in detail to the drawings, as shown in FIGS. 1 and 2 a flashlight 10 has a lens 14 within a front cap 12 on a front housing section 16. A rear housing section 20 extends into the front housing section 16. A housing ring 18 is provided on the rear housing section 20 adjacent to the front housing section 16. And end cap 22 on the rear housing section 20 is removable to install or remove batteries from the flashlight 10.

Figure 3:
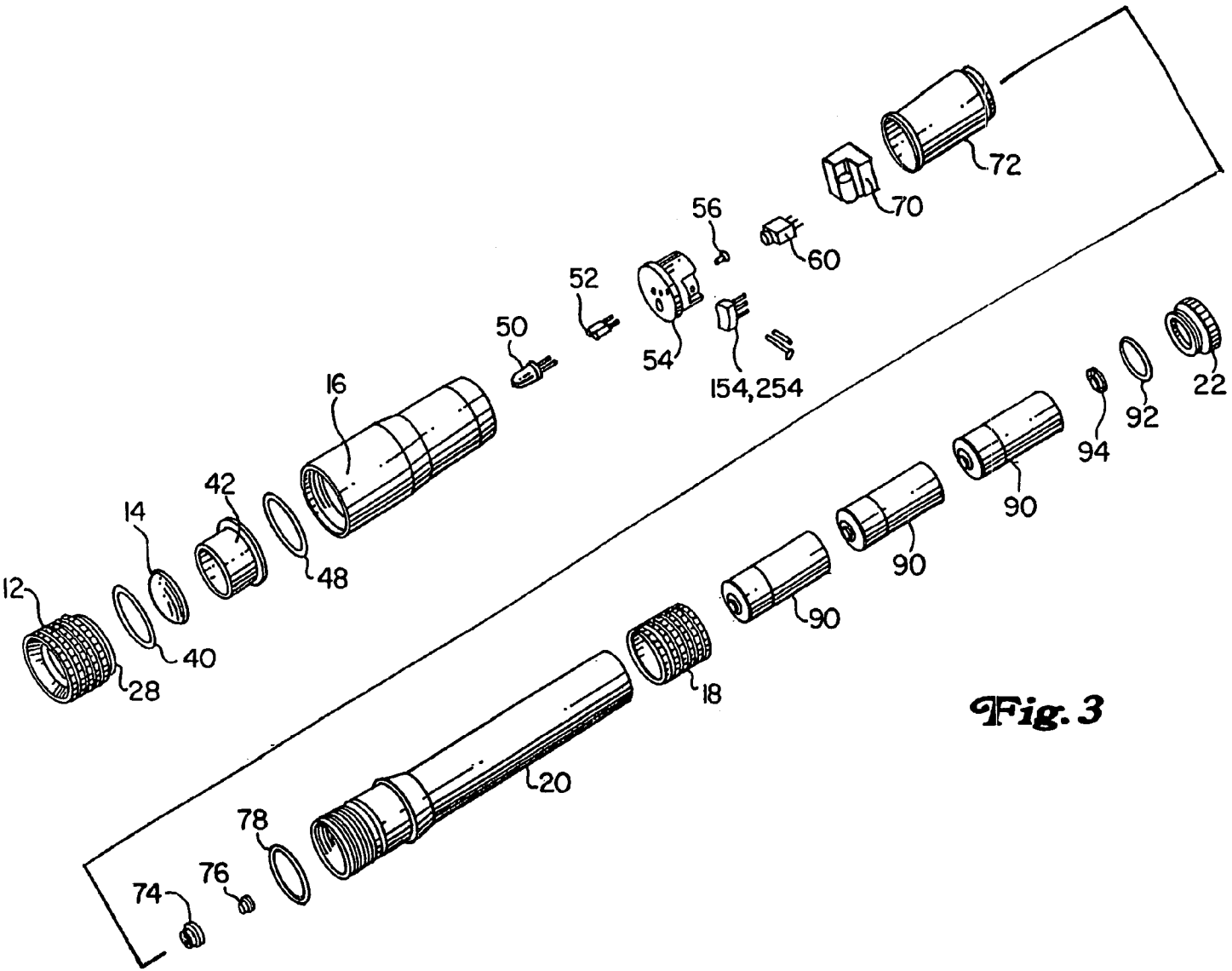
FIG. 3 is an exploded front and side perspective view of the flashlight shown in FIG. 1.
Figure 4:
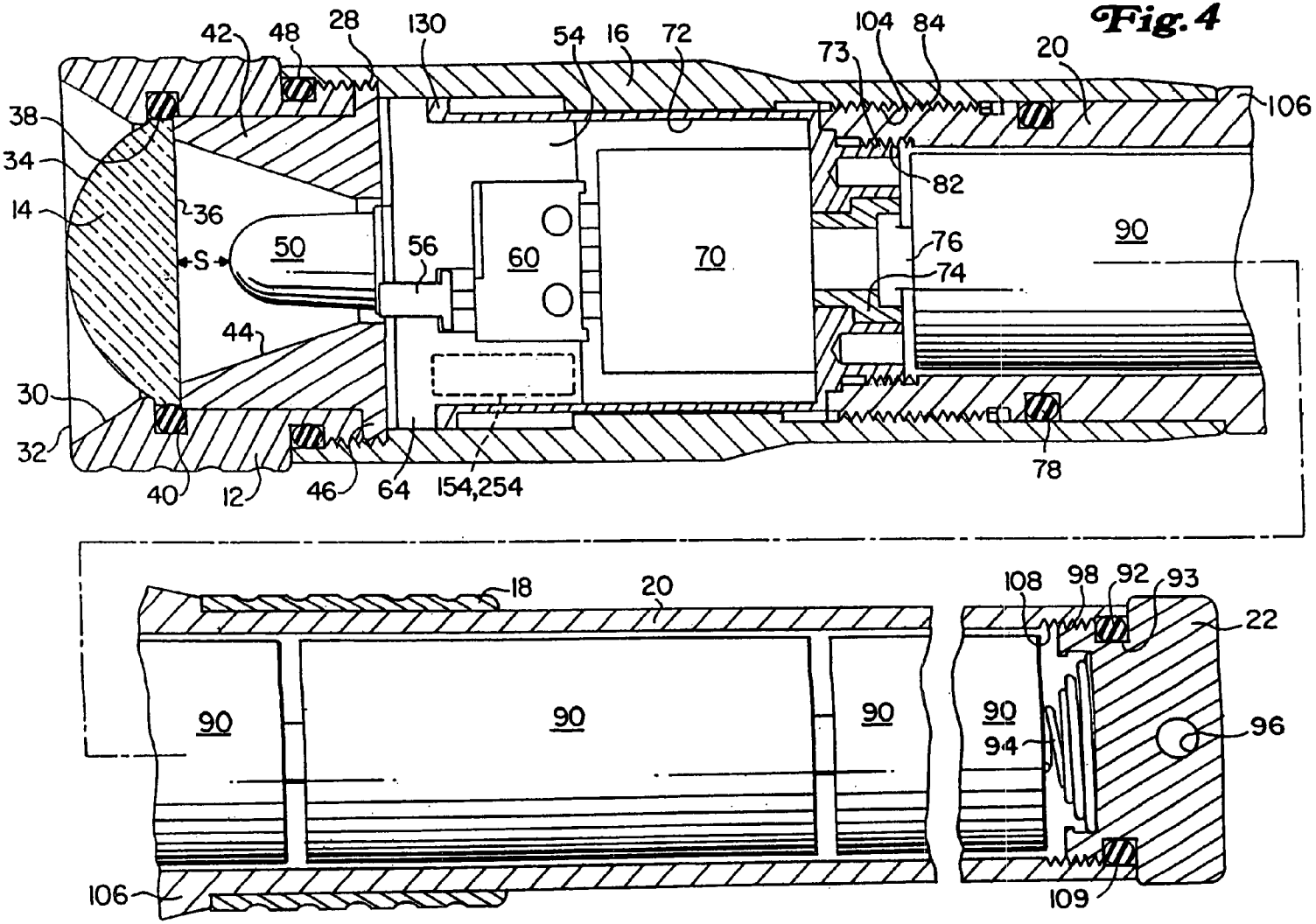
FIG. 4 is an enlarged section view of the flashlight shown in FIG. 1.
Figure 5:
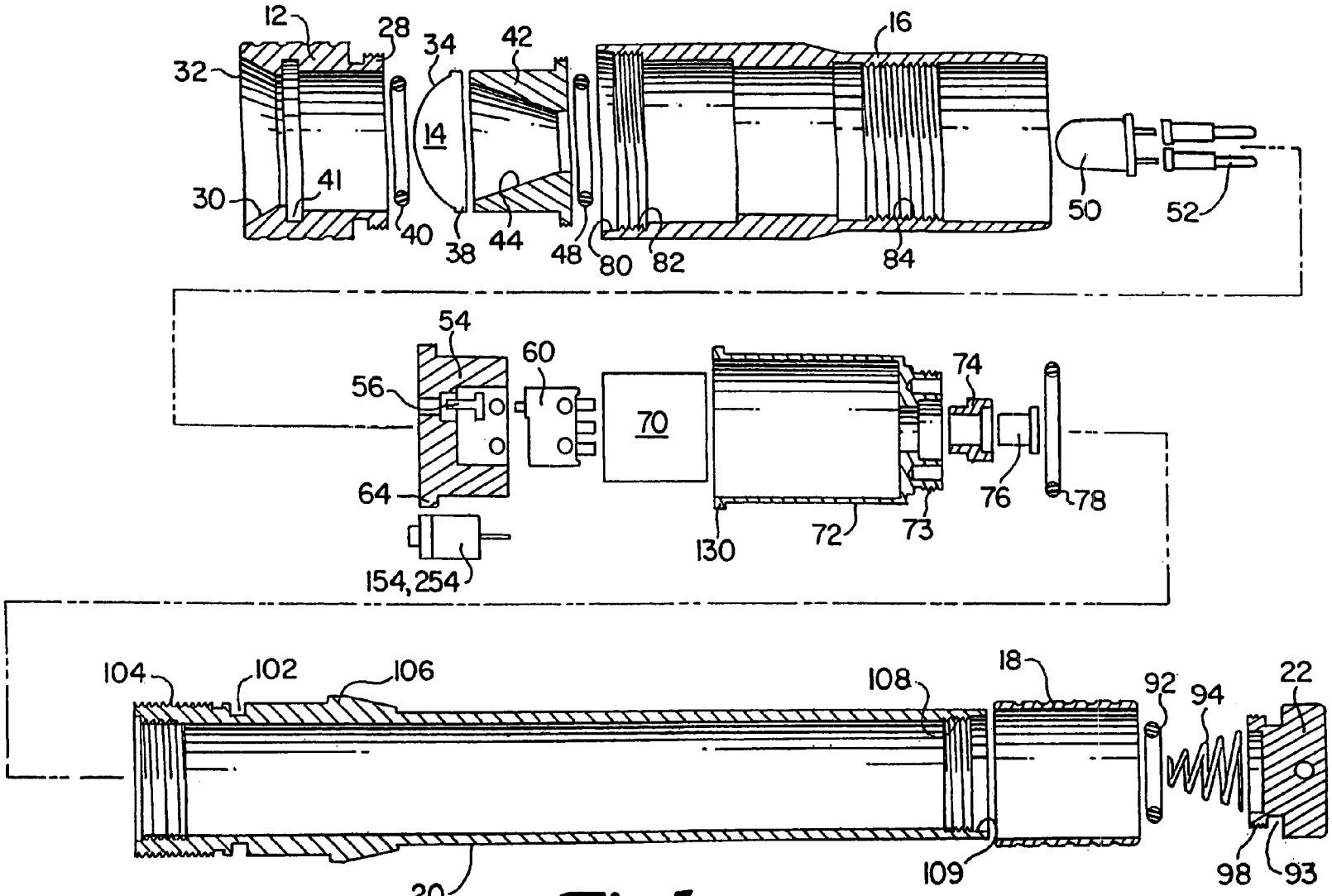
FIG. 5 is an enlarged exploded section view of the flashlight shown in FIGS. 1 and 4.
Figure 10:
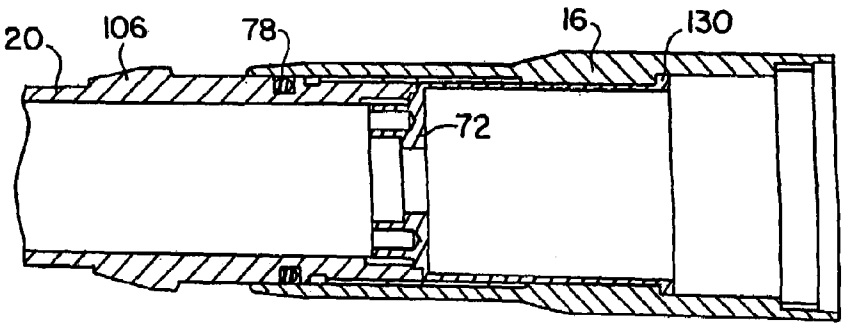
FIG. 10 is a section view of the flashlight shown in FIGS. 1–5, with the front housing section in a fully extended position.
Figure 11:
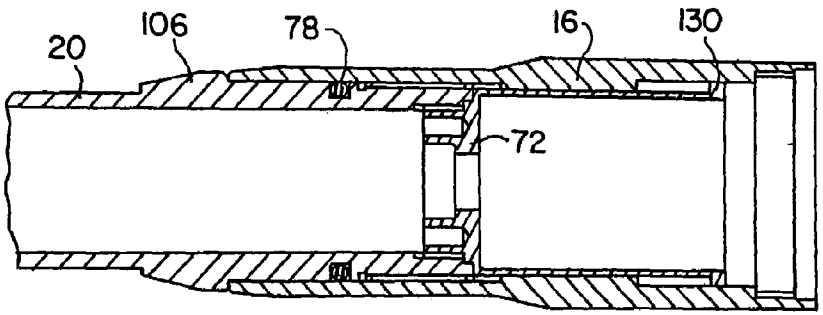
FIG. 11 is a section view showing the flashlight in a fully retracted or off position.

Referring now to FIGS. 3, 4 and 5, the front cap 12 has a conical surface 30 at its front end 32. A seal groove 41 is provided adjacent to the conical surface 30 on the front cap 12 as shown in FIG. 5. Screw threads 28 are provided on the back end of the cap 12.

Referring to FIGS. 4 and 5, the lens 14 is preferably an aspheric glass, piano convex, or other suitable (depending on LED selection and focal length) lens. The lens 14 has a spherical front surface 34, and preferably a flat rear surface 36 facing the LED 50. A cylindrical or ring surface 38 at the back end of the lens 14 seals against a seal element, such as an O-ring 40 in the seal groove 41 as shown in FIG. 5. The lens 14 preferably has a focal length of 8–16, 10–14 or 12 mm. The lens is sufficiently thick enough to provide adequate strength to resist pressure equivalent to 2800 meters of water. The center thickness is typically 5–6 millimeters. The term "lens" means an element that focuses or bends light.

Referring to FIGS. 4 and 5, a lamp housing 42 having a conical inside wall 44 is placed or pressed into the front cap 12, holding the lens 14 and O-ring 40 in place. The threaded back end 28 of the front cap 12 is threaded into internal screw threads 82 at the front end of the front housing 16. The lamp housing 42 is longitudinally positioned within the front cap 12 via a flange 46 at the back end of the lamp housing 42 stopping on the back end of the front cap 12. A front cap O-ring or seal 48 seals the front cap 12 to the front housing 16.

The front housing 16 is threaded onto the rear housing 20 via internal threads 84 on the front housing 16 engaged with external threads 104 at the front end of the rear housing 20. The components described above (i.e., the front cap 12, lens 14, O-ring 40, lamp housing 42, and O-ring 48) are all supported on (directly or indirectly) and move with, the front housing 16.

Referring still to FIGS. 4 and 5, the LED, light source or lamp 50 has anode and cathode leads extending into electrical contacts 52 in a switch housing 54. A microswitch 60 is supported within the switch housing 54. A plunger 56 extends from the microswitch 60 through and out of the front end of the switch housing 54, with the plunger biased outwardly against the back surface of the housing 42. The switch housing 54 is supported on or in the front end of a switch housing tube 72. A rim or collar 64 contacts the front end of the switch housing. The contacts 52 extend through contact bores or openings 62 in the switch housing 54, as shown in FIG. 8.

A circuitry module 70 within the switch housing tube 72 is electrically connected to the switch 60, and also to the batteries 90 via a battery contact 76 extending through a tube collar 74 at the back end of the switch housing tube 72. As shown in FIG. 4, a housing seal 78 seals the front end of the rear housing section 20 to the back end of the front housing section 16, while still allowing the front housing section 16 to turn, and shift longitudinally (along a center axis of the flashlight), as the front and rear housing sections are turned relative to each other.

The rear housing section 20 has an open internal cylindrical space for holding the batteries 90. In the embodiment shown in FIGS. 4 and 5, three N size batteries are used. Of course, different numbers and types of batteries may be used, consistent with the requirements of the LED 50 and circuitry module 70 provided. The front end of the rear housing section 20 includes a seal groove 102 as shown in FIG. 5, just behind the external threads 104, to hold and position the housing seal 78. A stop 106 limits the rearward range of travel of the front housing section 16 on the rear housing section 20. A housing ring 18 is pressed onto the rear housing section 20 and positioned adjacent to the stop 106. At the back end of the flashlight 10, threads 98 on the end cap 22 are engaged with rear internal threads 108. An end cap seal or O-ring 92 within a groove 93 on the end cap 22 seals the end cap 22 against a recess 109 in the rear housing section 20. A battery spring 94 grounds the negative terminal of the rear most battery to the rear housing section 20, and forces the batteries 90 into contact with each other and with the battery contact 76. A hole 96 through the end cap 22 allows the flashlight 10 to be mounted on a key chain, key ring or wire.

Figure 13:
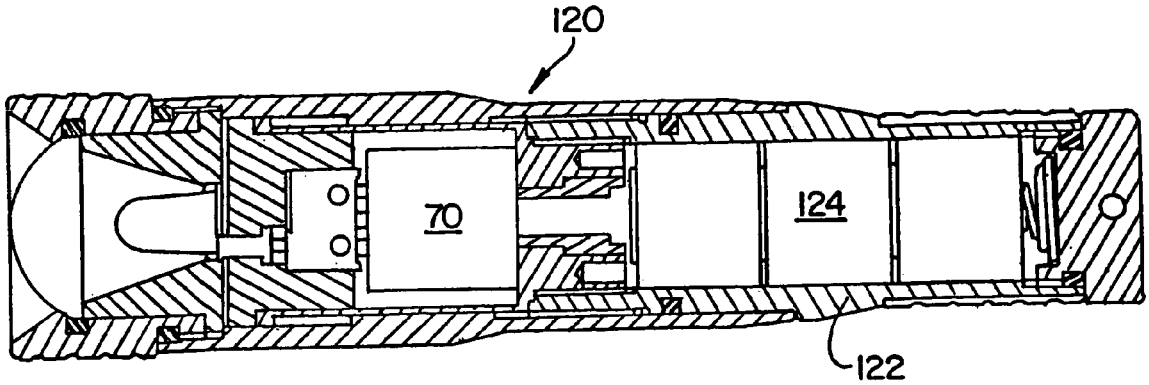
FIG. 13 is a section view of an alternative embodiment.

FIG. 13 shows an alternative embodiment having a shorter length than the flashlight shown in FIGS. 1–5. The shorter length is provided by having a shorter rear housing section 122 and using shorter batteries 124. The flashlight 120 in FIG. 13 is otherwise the same as the flashlight 10 shown in FIGS. 1–5.

The LED 50 is preferably an NSPW510BS, with a 50° directivity angle available from Nichia Corporation, Tokyo, Japan. The directivity angle generally is the included angle of the solid cone of light emanating from the LED. Outside of this solid conical angle, there is little or no light. Within the directivity angle, with most preferred LED's, the light is reasonably uniform, with some decrease in intensity near the sides or boundary of the angle. The directivity angle is specified by the LED manufacturer. Other more powerful LEDs will soon be available, which may affect lens selection. The lens 14 is preferably an aspheric 01LAG001, 2 or 111 available from Melles Griot, Carlsbad, Calif., USA. A plano/convex lens or other lenses may also be used. The lens preferably has a high level of strength to better resist pressure, such as water pressure when used underwater. In general, the front or outwardly facing surface of the lens will be curved, domed, or convex, as shown in FIG. 4, to better resist pressure forces.

Experimentation with LED's and lenses reveals that, in terms of flashlight performance, a specific relationship exists between the directivity angle A of the LED and the focal length of the lens f. For preferred performance characteristics, the ratio of A/f is within the range of 3.5 to 6.5, preferably 4 to 6 or 4.5 to 5.5, and more preferably approximately 5.

Figure 19:
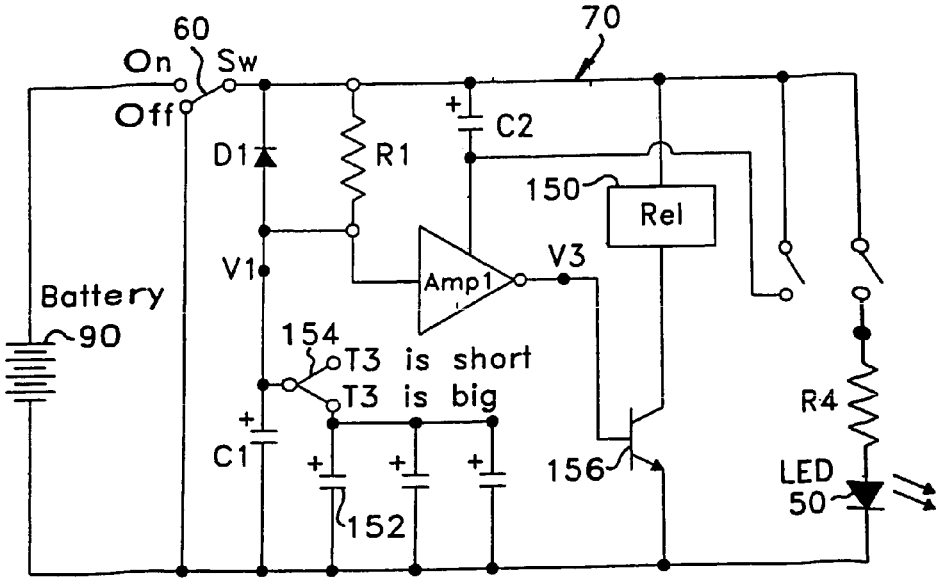
FIG. 19 is a schematic illustration of the shut off timer circuit in the circuitry module shown in FIGS. 3–5.

FIG. 4 shows the flashlight 10 in the off position. The front housing section 16 is threaded onto the rear housing section 20, until it comes to the stop 106. In this position, the plunger 56 is almost entirely within the switch housing 54, causing the switch 60 to be in the off position. Electrical power provided from the batteries 90 through the battery contact 76 and circuitry module 70, as well as through the rear housing section 20, is provided to the switch 60. The switch 60 is also connected to the LED, as shown in FIG. 19. As the switch 60 is in the off position, no power is provided to the LED. To turn the flashlight 10 on, the front housing section 16 is turned (counter clockwise in FIG. 1) causing it to move forward via the interaction of the threads 104 and 84. As the front housing section 16 moves forward, the front cap 12, lens 14 and the lamp housing 42 move with it. The LED 50, switch housing 54, plunger 56, switch 60 circuitry module 70 all remain in place, as they are supported within the switch housing tube 72 which is fixed to the rear housing section 20.

As the LED or light source 50 and lamp housing 42 move away from the switch housing 54, the plunger 56, biased by spring force in the switch 60 also moves forward or outwardly. This movement causes the switch 60 to move into an on position. In the on position, the electrical power is provided to the LED 50. To focus the light from the LED or light source 50, the user continues to turn the front housing section 16. This increases the spacing "S" between the lens 14 and the LED 50, allowing light from the LED to be focused to a desired distance. A position stop 130 on the front end of the switch housing tube 72 prevents the front housing section 16 from separating from the rear housing section 20. When the front housing section 16 is turned to its maximum forward position (where further forward movement is prevented by the stop 130), the lens 14 focuses the light to a maximum distance.

Figure 12:
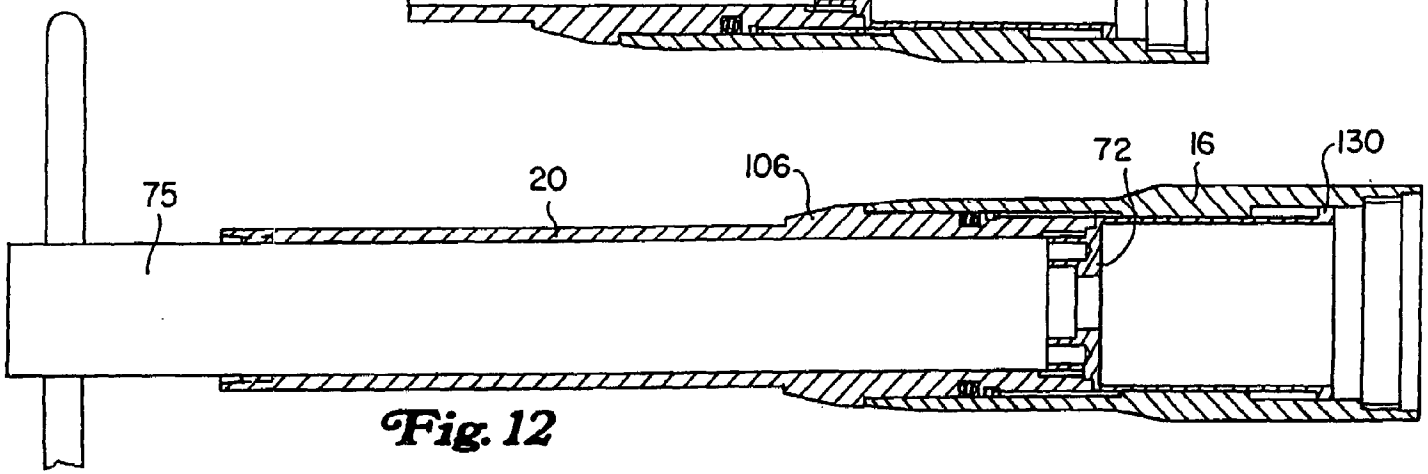
FIG. 12 is a section view showing installation of the switch housing

Referring momentarily to FIG. 12, the switch housing tube 72 is installed from the front end of the front housing section. The threaded section 73 of the switch housing tube 72 engages with the threads 82 on the front housing section. The spanner tool 75 is inserted through the back end and is used to tighten the switch housing tube 72 in place. The rim or stop 130 at the front end of the switch housing tube acts as a mechanical stop to prevent the front housing section from separating from the rear housing section.

The combination of the LED 50 and the lens 14 allows the flashlight 10 to focus, and also to provide a narrow direct beam of light. The focusing range of the lens 14 allows filaments of the light source, which appear in the beam, to be used as pointers or indicators. A light beam provided by the flashlight 10 has minimal dark spots. In addition, the spot pattern produced by the flashlight 10 is nearly a perfect circle, throughout the entire range of focus. The LED or light source 50 may be provided in various colors.

In general, light from the LED is focused by the lens, and no reflector is needed. However, with some LEDs, use of a reflector, in combination with a lens, may be advantageous. If the LED used has a large directivity angle, for example, 60, 70, 80, 90 degrees, or greater, the lamp housing 42 can also act as a reflector. Specifically, the interior curved or conical surface or wall 44 is made highly reflective, e.g., by polishing and plating. The divergence angle of the wall 44, or curvature, is then selected to reflect light towards the lens. While in this embodiment the reflector (formed by the surface 44) moves with the lens, a fixed reflector, e.g., supported on the switch housing 64, may also be used.

The housing ring 18 and front cap 12 provide convenient grip surfaces for turning the front and rear housings relative to each other to switch the flashlight 10 on and off, and to focus the light beam. The housing seal 78 is the only dynamic seal in the flashlight 10. The other seals are static.

Referring to FIG. 19, when the flashlight 10 is turned on by twisting or turning the front and rear housing sections 16 and 20, the switch 60 closes, or moves to the on position. Battery voltage 90 is then applied to the relay 150, causing the relay to close. Consequently, current flows through the LED 50 generating light. At the same time, the capacitor C1 begins to charge. When the voltage V1 across the capacitor C1 reaches a trigger level, it causes the output of the amplifier 158 (which act as an inverter) to cause the transistor 156 to switch the relay off or open. Power to the LED 50 is then interrupted, preserving the life of the battery 90.

To turn the flashlight 10 back on, the switch 60 is returned to the off position by turning the front and rear housing sections in the opposite directions. With the switch 60 in the off position, the capacitor C1 discharges through the resister R1, returning V1 to zero, and effectively resetting the timer 70. When the switch 60 is moved back to the on position, power is again supplied to the LED, and the flashlight is turned on to provide light. The timer circuit 70 reset to turn off power to the LED after a preset interval. The preset interval is determined by selecting the value of C1. By providing one or more additional capacitors 152 and a capacitor switch 154, the time interval before shut off can be adjusted, or selected from two (or more) preset values. The switch 154 is on or in the switch housing 54, is typically set by the user's preference, and then remains in the shorter or longer internal position. The second switch position can be a timer bypass option.

Turning now to FIGS. 14–18, in another flashlight embodiment 200, three lamps or LED's 50 are provided, and a lens 14 is aligned and associated with each LED 50. Except as described below, the flashlight 200 is similar to the flashlight 10 described above. A lens ring 202 and a lens base 204 have three openings 206 for receiving or holding three lenses 14. Each lens 14 is secured in place on the lens ring 202 within an O-ring 208. The lens ring 202 and lens base 204 are attached to each other by screw threads, adhesives, etc., after the lenses 14 are placed into the lens ring 202. Counterbores 209 extend into the back surface of the lens base 204. Anti-rotation pins 210 extend from the switch housing 212 into the counterbores. As the switch housing 212 is fixed to the rear housing section 214, the lens ring 202 does not rotate with the front housing. The lenses 14 in the lens ring can move longitudinally towards and away from the LED's, while staying aligned with the LED's. The switch housing 212 holds three LED's 50, with each LED aligned with a lens 14. A Teflon (Fluorine resins) washer 214 between the front housing section 216 and the lens base allows the front housing section 216 to rotate and slide smoothly against the lens base 204, as the front housing section 216 is rotated to turn on or focus the flashlight 200. Similarly, a low friction O-ring or seal 218 supports the lens ring 202 within the front housing section 216, while allowing for rotational and front/back sliding movement between them. A front cap 220 is sealed against the front housing section 216 with an O-ring or seal 222.

In use, as the front housing section 216 is twisted or rotated, it moves front to back via the interaction of the screw threads 104 and 84. The LED's 50 remained fixed in place. The lenses 14 move front to back, with movement of the front housing section, but they do not rotate as the lens ring 202 and lens base 204 are held against rotation or angular movement by the pins 210. Consequently, light from each of the three LED's 50 can be focused with movement of the front housing section 216. Of course, the design shown in FIGS. 14–18 is suitable for use with 2, 3, 4 or any number of additional LED's.

Figure 20:
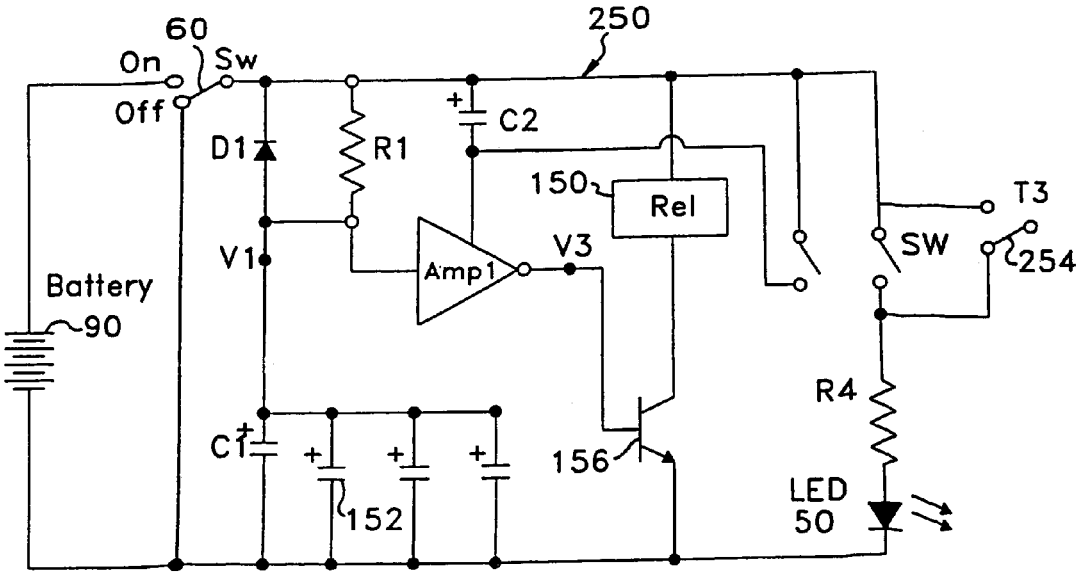
FIG. 20 is a schematic illustration of an alternative shut off timer circuit for use in the circuitry module shown in FIGS. 3–5.

Turning to FIG. 20, in an alternative timer circuit 250, the switch 154 is removed and replaced with a continuous or permanent on switch 254. The switch 254, when closed, connects the LED 50 and the resistor R4 directly to the battery 90. All of the other components are bypassed. As a result, when the switch 254 is closed, the timer circuit 250 is inactive or disabled, and illumination by the LED is controlled purely by the switch 60. This design is advantageous where the user wants the flashlight to remain on until manually turned off using the switch 60, which is actuated by turning the front housing section. When the switch 254 is in the open position, the timer circuit shown in FIG. 20 operates in the same way as the timer circuit 70 shown in FIG. 19. With the switch 254 open, the timer circuit 250 automatically turns the flashlight off after a preset interval of time determined by the capacitors C1 and 152. The timer circuit 250 otherwise operates in same way as the timer circuit 70, except as described above.

Figure 14:
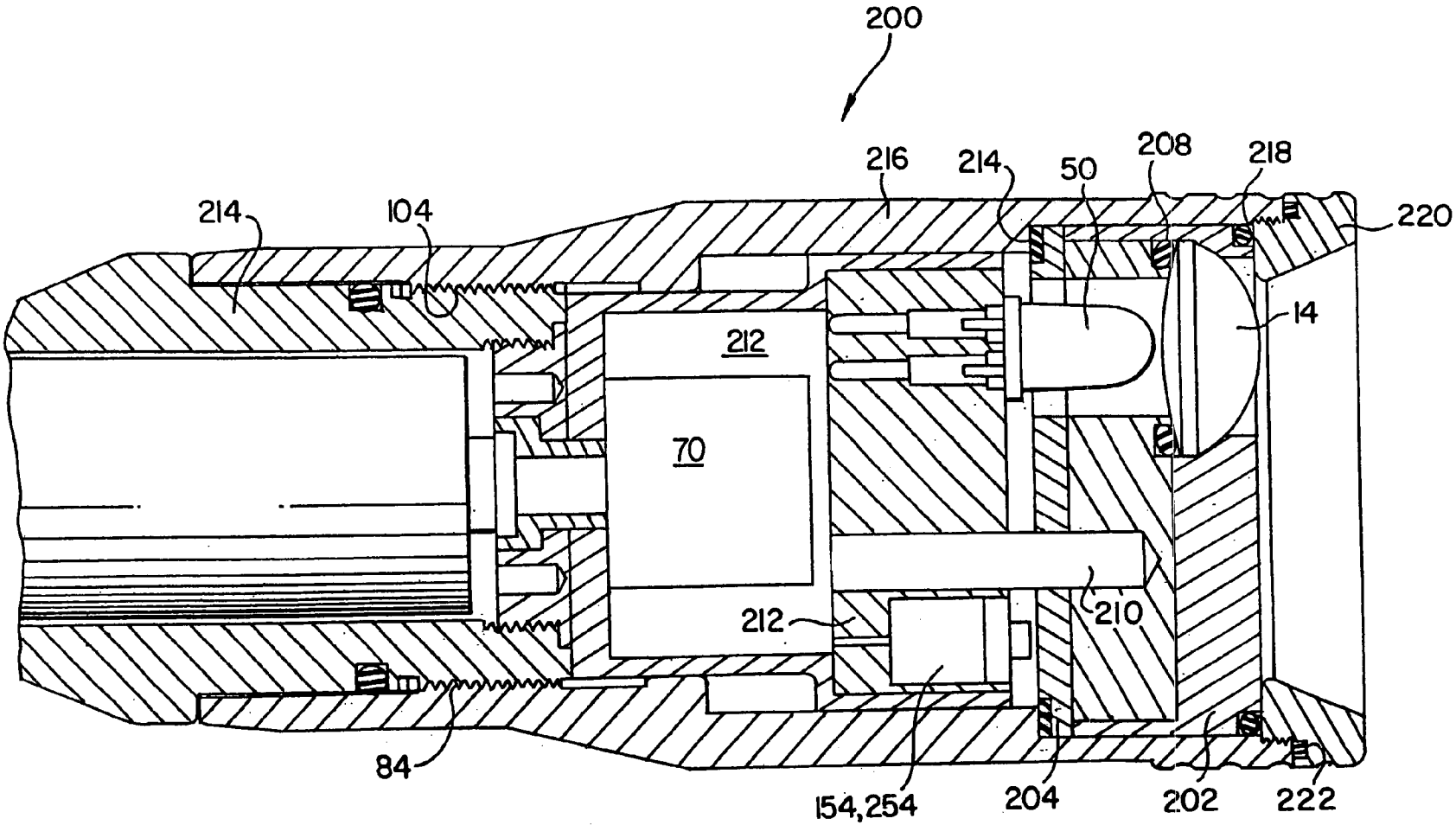
FIG. 14 is a section view of another alternative embodiment.
Figure 17:
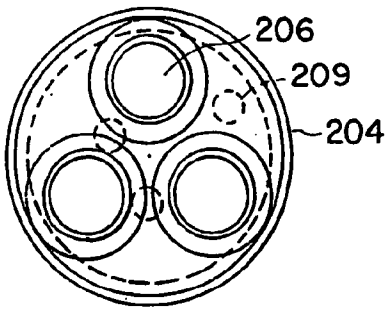
FIG. 17 is an elevation view taken along line 17—17 of FIG. 15.
Figure 16:
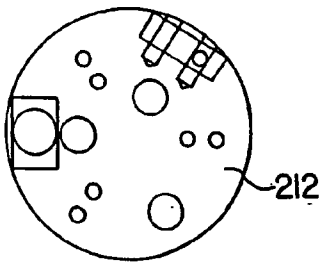
FIG. 16 is an elevation view taken along line 16—16 of FIG. 15.

Referring momentarily to FIGS. 5 and 17, the switch 154 or 254 is set in the open or closed position by removing the front cap 12, along with the lens 14, O-ring 40, and the lamp housing 42 (which remain as a single sub-assembly with the lamp housing pressed into the front cap 12). Referring to FIG. 6, an instrument, such as a small screwdriver blade, or even a pen or pencil tip, is inserted through the access hole 57 in the switch housing 54 to set the switch 154 or 254 to the desired position. The switch 154 can be set to a shorter or a longer time interval before automatic shutoff. If the switch 254 is used, the switch positions are automatic shutoff mode (determined by the capacitors), or "permanent on" where the flashlight acts as a conventional flashlight controlled entirely by the switch 60, and with no automatic shutoff feature. Referring to FIG. 14, in the embodiment 200, the switch 154 or 254 is set by removing the front cap 220, along with the O-rings 208 and 222, the lens ring 202, the lens base 204, and the lenses 14 (which remain as single sub-assembly). The switch 154 or 254 is then readily directly accessible.

Figure 15:
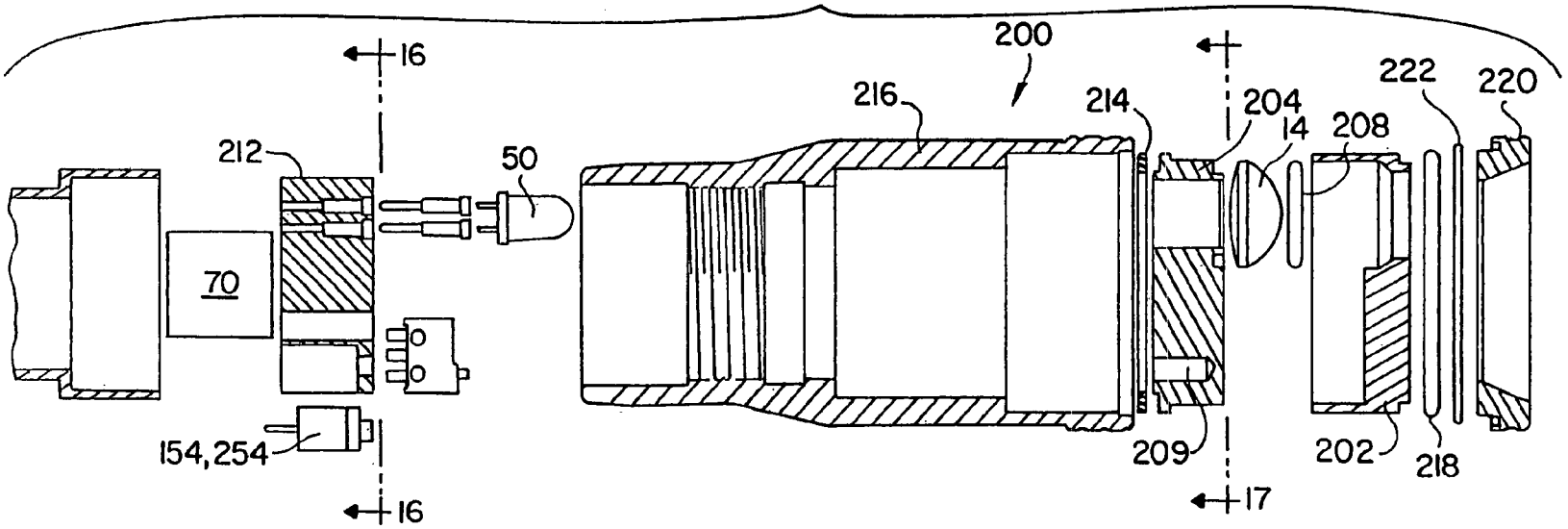
FIG. 15 is an exploded section view of the flashlight shown in FIG. 14.
Figure 18:
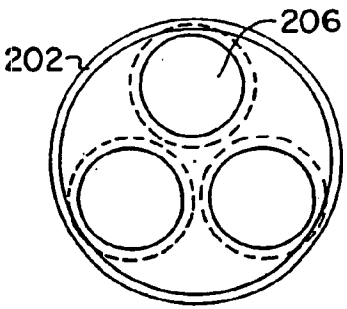
FIG. 18 is an elevation view taken along line 18—18 of FIG. 15.
Figure 21:
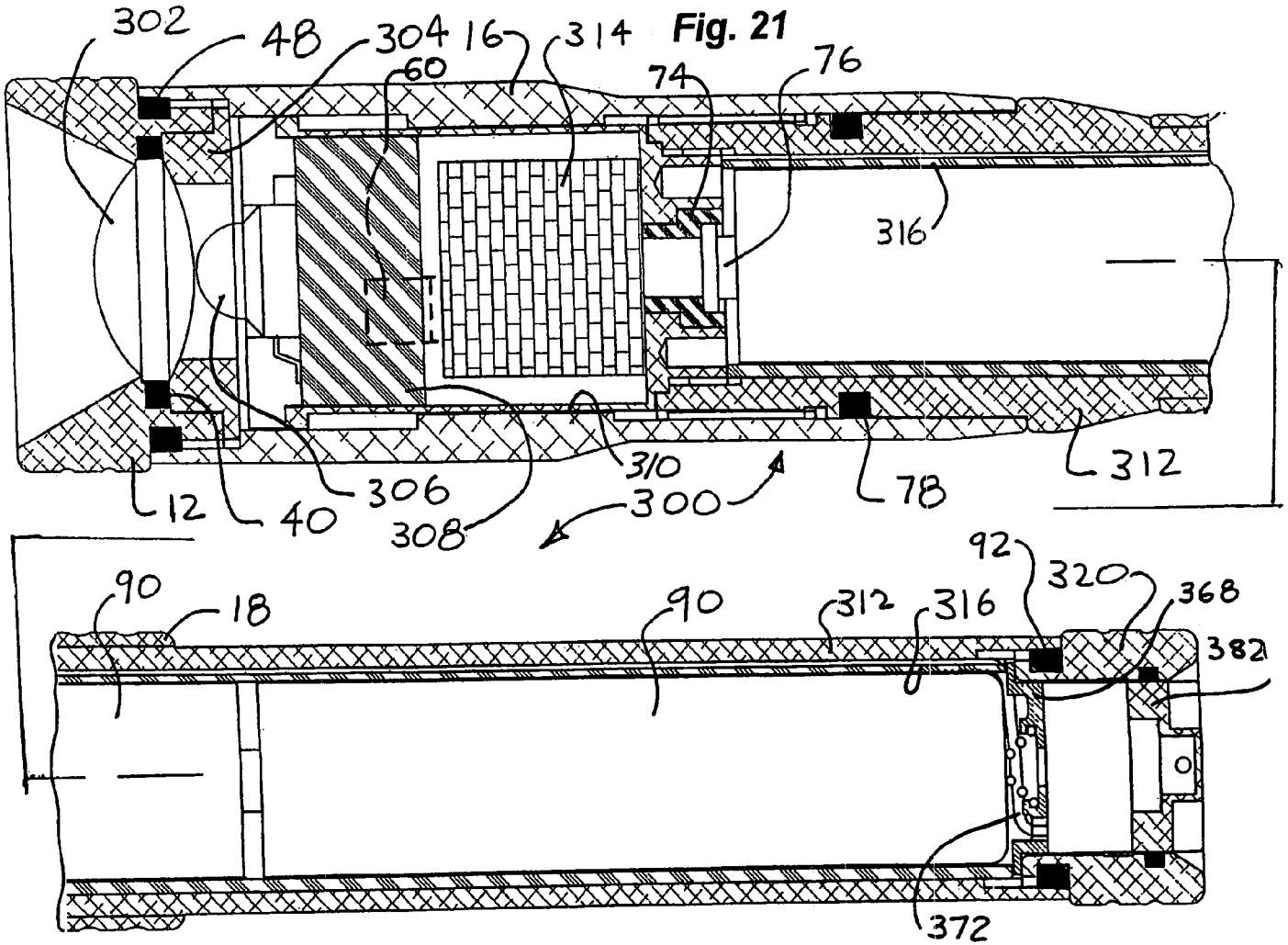
FIG. 21 is a section view of an alternative flashlight.
Figures 22, 23, 24, 25, 26, 27:
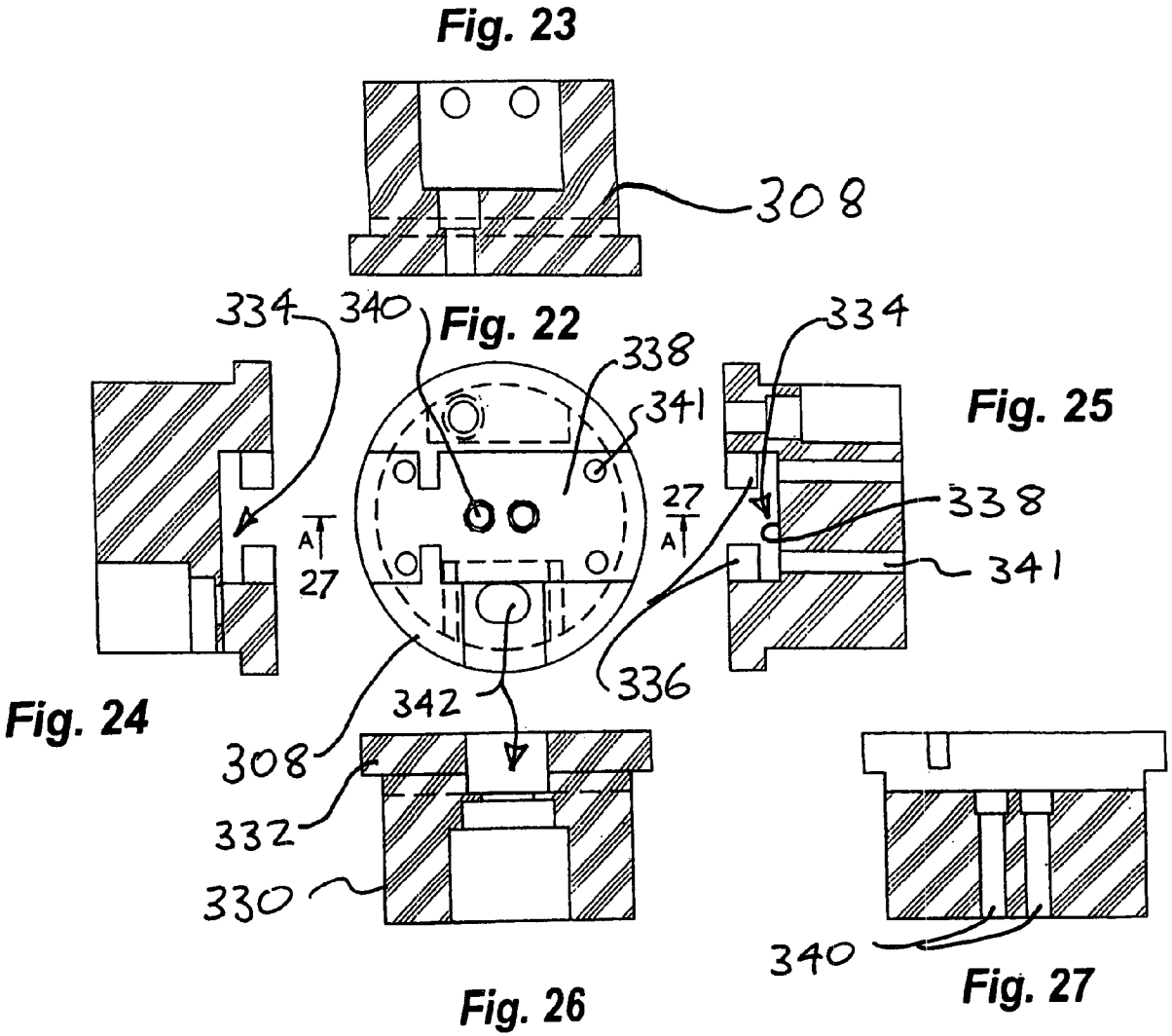
FIG. 22 is a top view of the bulb or LED holder shown in FIG. 21.
FIG. 23 is a right side view thereof.
FIG. 24 is a front view thereof.
FIG. 25 is a rear view thereof.
FIG. 26 is a left side view thereof.
FIG. 27 is a section view taken along line 27—27 of FIG. 22.

Turning to FIG. 21, an alternative embodiment flashlight 300 includes additional features, which may be used alone, or in combination with each other, and with one or more of these features also usable in the flashlights shown in FIGS. 1, 13, and 15. These features include a dimmer, which allows the brightness of the bulb or LED(s) to be adjusted by turning an end knob or cap. Another feature includes a current controller which may be used to maintain the brightness, as battery power decreases. Another feature is a switch which may be momentarily pushed in and switched on, or pushed in and held in an on position to provide maximum brightness, regardless of other control functions in use. An additional function allows the timer described above to be made adjustable, using a knob or switch on the flashlight.

As shown in FIG. 21, in the flashlight 300, a lens 302 is held within a lens housing 304. One or more LEDs 306 or bulbs are held in place on an LED holder 308. The LED holder 308 is supported within a switch housing tube 310, similar to the switch housing tube 72 described above. A rear housing 312 is threaded into a front housing 16. The rear housing 312 may be the same as the rear housing 20 shown in FIGS. 1–5, except that it preferably has a larger internal bore, to accommodate a plastic tube liner 316.

Figures 28, 29, 30, 31, 32:
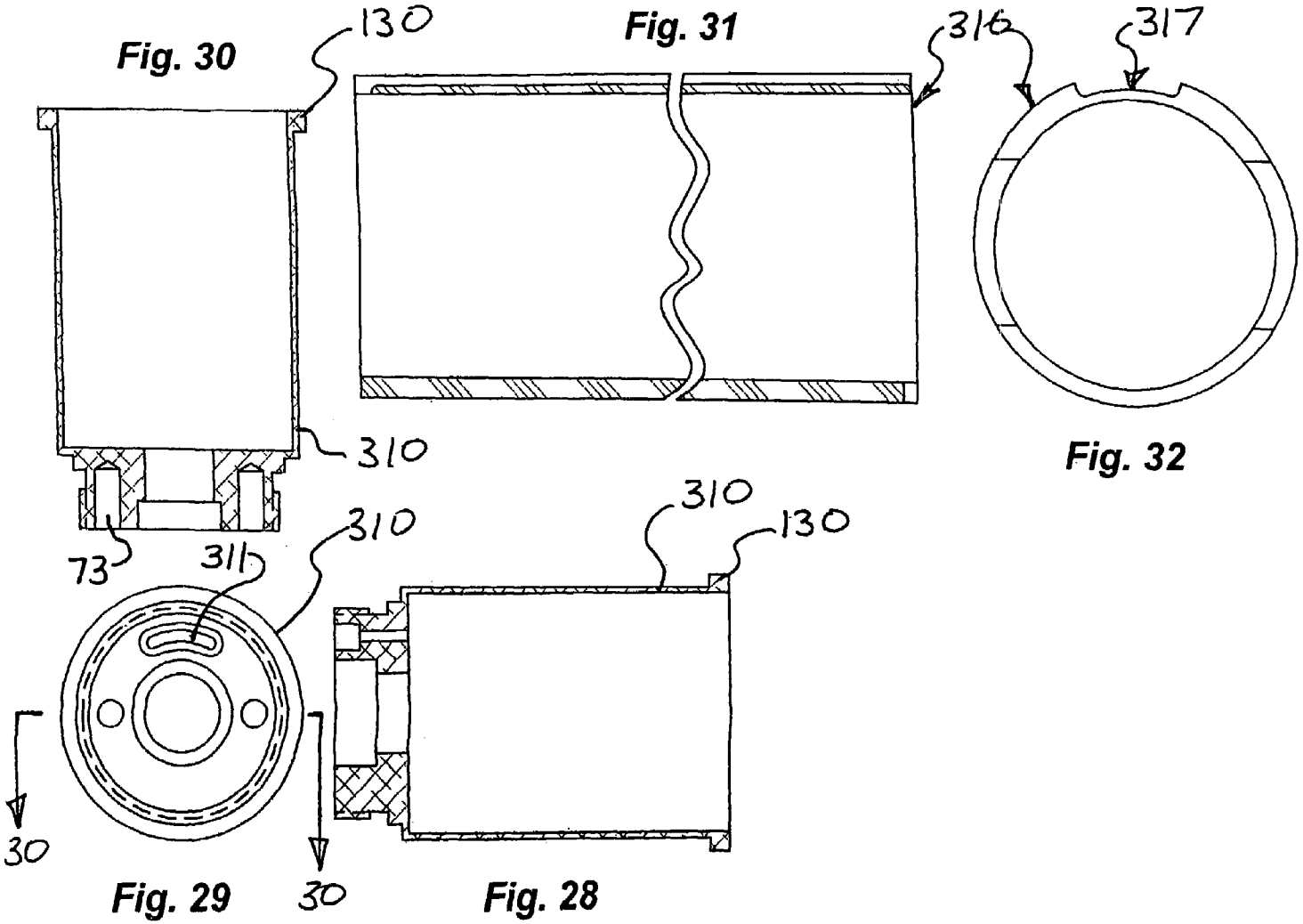
FIG. 28 is a section view of the switch housing tube shown in FIG. 21.
FIG. 29 is a back end view thereof.
FIG. 30 is a section view taken along line 30—30 of FIG. 29.
FIG. 31 is a section view of the tube liner shown in FIG. 1.
FIG. 32 is an end view thereof.

Referring momentarily to FIGS. 31 and 32, the tube liner 316 includes a wiring slot 317, to provide space for wires running from a circuitry module 314 within the switch housing tube 310 to the back end of the flashlight 300. Referring to FIGS. 28–30, the switch housing tube 310 similarly includes a wire slot or opening 311 for routing of the wire bundle 372.

Turning now to FIGS. 22–27, the LED holder 308 is similar to the switch housing 54 shown in FIGS. 6–9. However, the LED holder 308 is preferably made of a metal, e.g., aluminum, to better also act as a heat sink for use with higher power LEDs. The cylindrical body 330 of the holder 308 fits within the front end of the switch housing tube 310, with the head or rim 332 acting to position the holder 308 within the switch housing tube 310. An LED slot 334 is formed between a base or land area 338 and overhanging tabs 336. Central LED lead openings 340 extend through the holder 308, for use with LEDs or lamps having straight leads. Side LED lead openings 341 are provided for use with LEDs having lateral leads. Accordingly, the holder 308 can be used with a large variety of LEDs or lamps. A switch pin opening 342 extends through the holder 308 to allow on/off switching of the microswitch 60, with twisting movement between the front and rear housings as described above. The base area 338 provides a flat and smooth surface for mounting a LED, and to better allow for heat flow from the LED into the holder 308. Thermal grease may be provided on the base area 338 to improve the heat flow path from the LED 306 into the holder 308, and ultimately to the front housing 16.

The holder 308 shown in FIGS. 22–27 is adapted for holding a single LED (or bulb). LEDs having lateral leads are installed by placing the LED on the base area 338 and then sliding the LED to a central position, so that the tabs 336 secure the LED in place. Straight lead LEDs are installed by simply inserting the straight leads into the lead openings 340.

Figure 33:
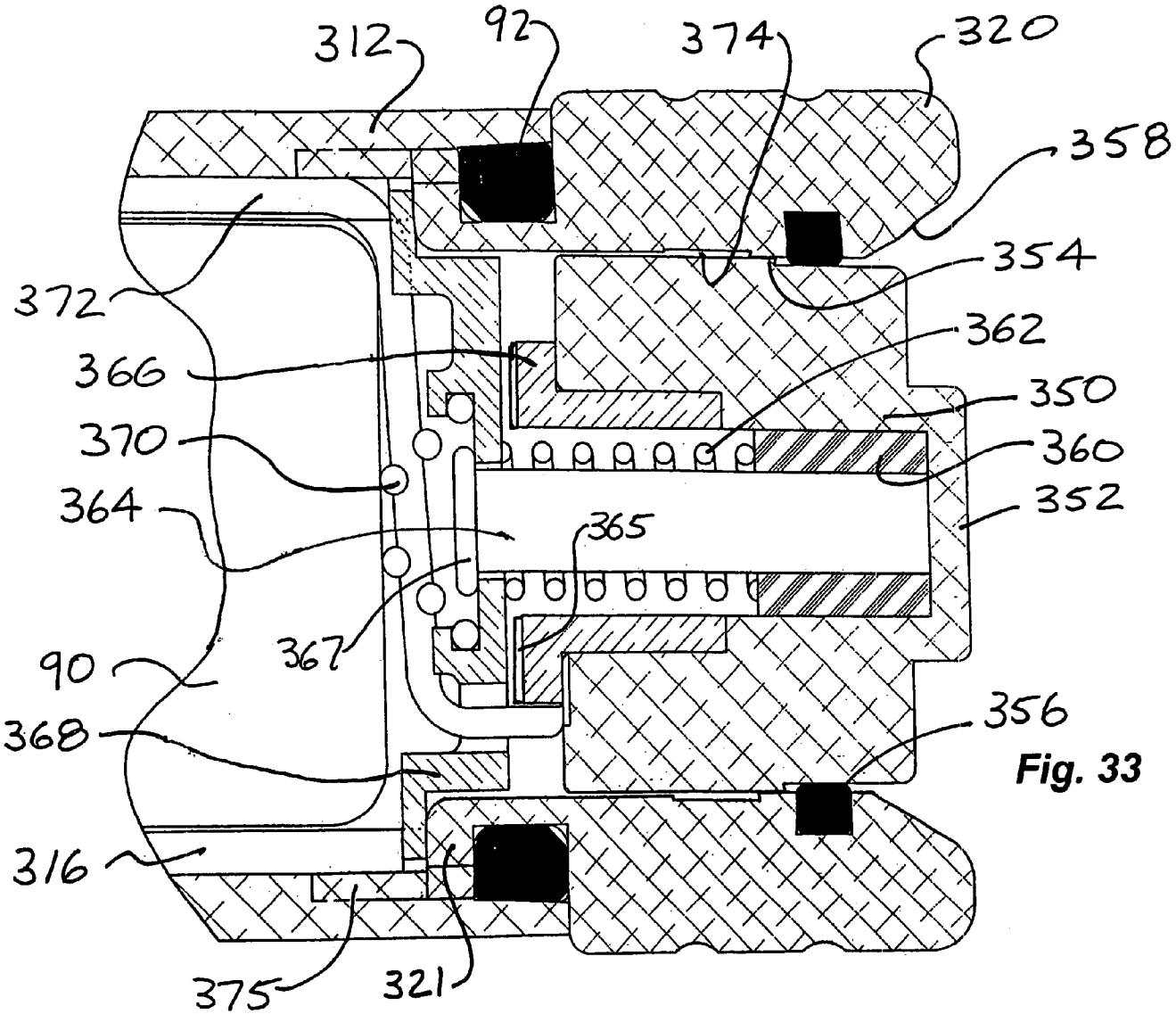
FIG. 33 is an enlarged partial section view of the flashlight shown in FIG. 21.
Figures 34, 35, 37, 38:
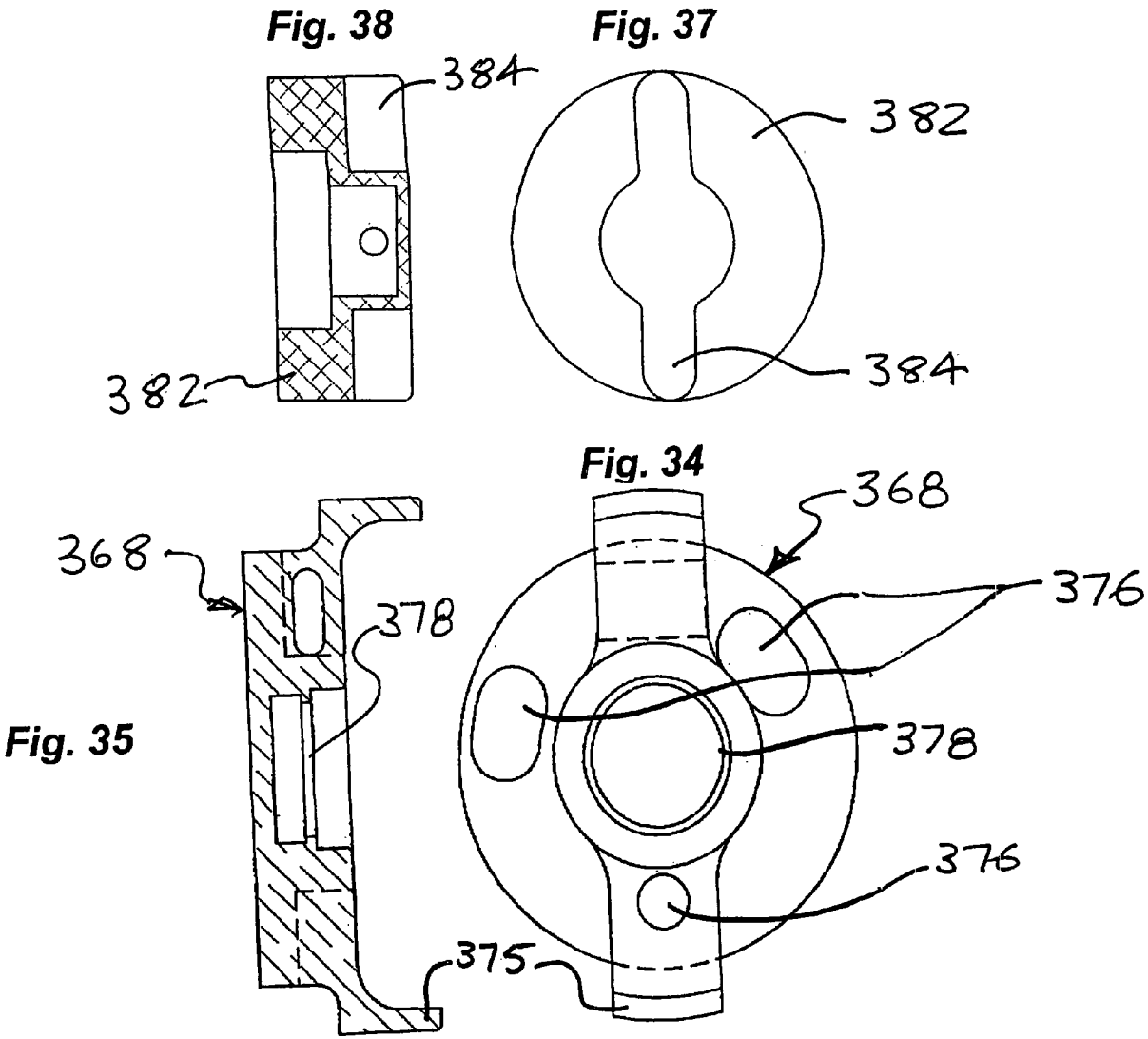
FIG. 34 is a front view of the spring plate shown in FIG. 33.
FIG. 35 is a section view thereof.
FIG. 37 is an end view of the end knob shown in FIG. 36.
FIG. 38 is a section view thereof.

FIG. 33 is an enlarged view of one embodiment of the back end of the flashlight 300 shown in FIG. 21. An end cap 320 having a conical opening 358 is threaded into the back end of the rear housing 312. A spring plate 368 (preferably brass) is secured between the back end of the tube liner 316 and a forward flange 321 of the end cap 320. Referring momentarily to FIGS. 34 and 35, the spring plate 368 includes a spring retainer or opening 378 and clearance holes or slots 376 to allow wires to pass through a spring plate 368. Anti-rotation tabs 375 on the spring plate 368 fit within slots in the tube liner, to prevent rotation of the spring plate 368, when the end cap is unscrewed to change the batteries. Referring again to FIG. 33, the back end of a battery spring 370 is secured within the spring retainer 378 of the spring plate 368. The front end of the battery spring 370 contacts a battery 90.

A push button 350 having a raised center 352 is slidably or telescopically secured within the end cap 320. A push button seal 356, such as an O-ring, seals the push button 350 with the end cap 320, while allowing longitudinal or in/out movement. Referring still to FIG. 33, an insulator pin 364 extends through the spring plate 368 and is secured within a spacer 360 in the push button 350. A compression spring 362 around the pin 364 pushes the push button 350 outwardly, until a head 367 of the pin 364 contacts the spring plate 368, preventing further outward movement of the push button 350. A contact ferrule 366 (preferably copper) is secured to the push button 350. Spring fingers 365 on the front of the ferrule 366 contact the spring plate, when the button 350 is pushed in. One or more wires 372 extending rearwardly from the circuitry module 314 are attached and electrically connected to the contact ferrule 366.

In use, the flashlight 300 may be turned on and off by twisting the front housing, as described above in connection with the flashlight shown in FIGS. 1–5. This movement operates the main power switch 60. The push button 350 in the flashlight 300 and the circuitry module 314 provide additional functions. These additional functions are provided via circuitry in the circuitry module 314 and via the push button 350.

Figure 39:
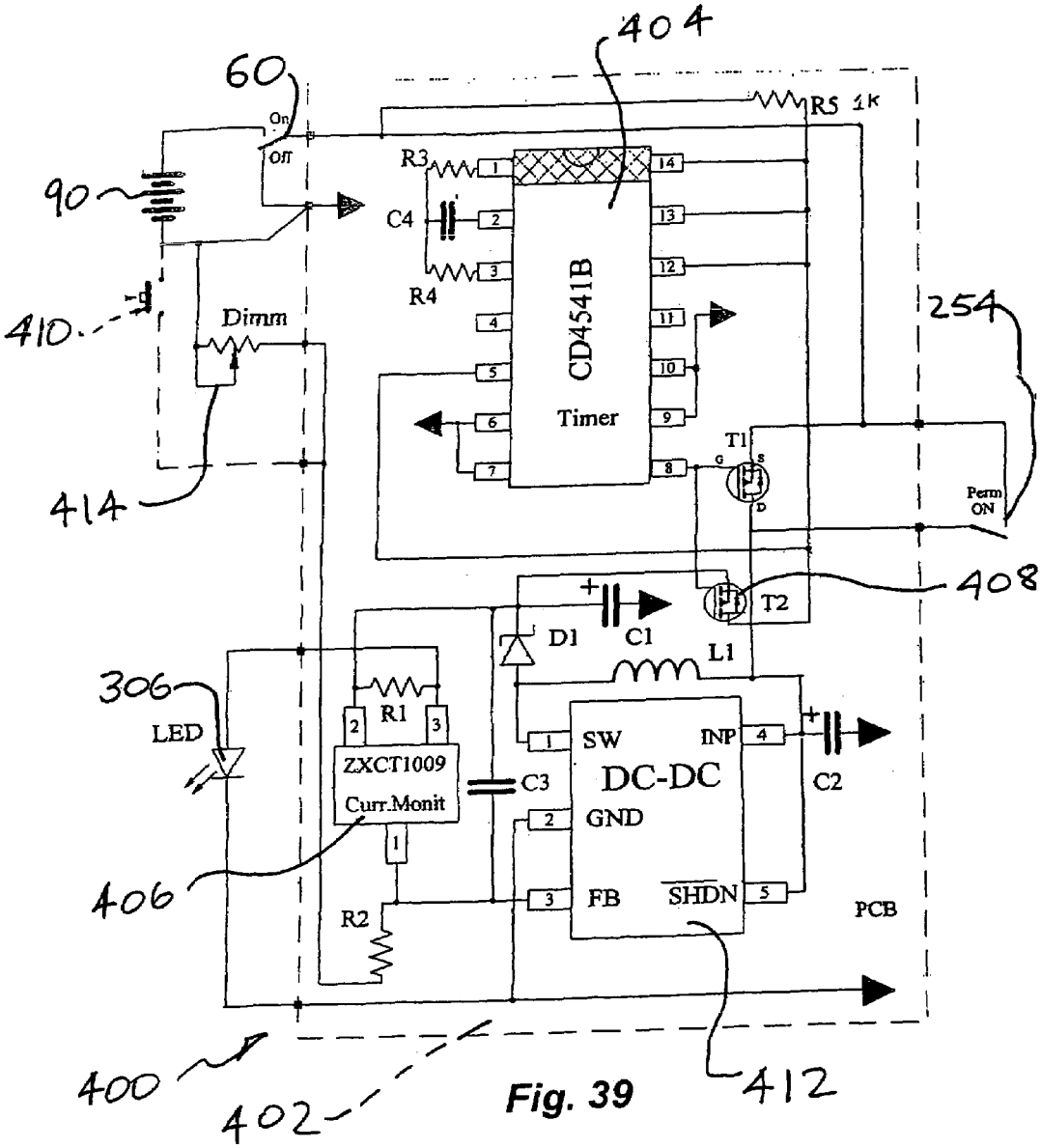
FIG. 39 is a schematic diagram of circuitry for use in the flashlight shown in FIG. 1 or 21.

Referring to FIG. 39, a flashlight circuit 400 has a timer 404, a current monitor 406, a current controller 412, MOSFETs 408, preferably on a circuit board 402 within the circuitry module 314, along with the discrete components shown. The current controller 412 allows current through the LED 306 to be maintained at a constant level, even as the voltage of the battery(s) 90 drops over time. In general, the current control function is used only when sustained maximum brightness is desired, since use of the current controller shortens battery life, or the output of the current controller is controlled via a potentiometer.

Referring to FIGS. 21, 33 and 39, the flashlight 300 can be turned on by twisting the front housing 16 relative to the rear housing 312. This movement causes the microswitch 60, shown in FIG. 21, to switch on. Referring to FIG. 33, when the push button 350 is pushed in, the contact ferrule 366 moves forward into electrical contact with the spring plate 368, closing the switch 410 shown in FIG. 39. The switch 410 is shown in dotted lines in FIG. 39 because FIG. 39 shows circuitry which may also be used in the flashlight shown in FIG. 36. Current flow from the batteries 90 to the LED 306 is then maintained by the current controller 412. Consequently, the LED 306 provides maximum brightness, regardless of battery condition. This function allows the user to quickly get maximum brightness by pushing the push button 350, regardless of other functions in use (e.g., timer, dimmer, blinking), since the push button activation of the current controller overrides all other functions. Consequently, this operation is especially useful in an emergency.

As shown in FIG. 33, due to the action of the spring 362, once the push button 350 is released, it will return to the out or original position, opening the switch 410 as the ferrule 366 separates from the spring plate 368. The current controller 412 is then disengaged. Any of the other functions can then resume. To maintain maximum brightness, the push button 350 is pushed in, and then slightly to one side via finger force on the raised area 352. This causes the shoulder 354 on the push button 350 to engage into the groove 374 on the inside surface of the end cap 320. Consequently, the push button 350 is held in the on position, the switch 410 remains closed, and maximum brightness is maintained indefinitely via the current controller 412. If the flashlight 300 is used under water, the push button 350 may be moved in purely via water pressure. Consequently, the flashlight 300 is automatically placed into a maximum brightness mode when submerged.

The MOSFETs 408 are controlled by the timer 404 to switch higher levels of current on and off, based on timer signals. The current monitor 406 detects current by measuring voltage drop across a resister, and sends a signal to the current controller 412.

To resist corrosion, the front and rear housings, and other aluminum components, such as the front and end caps, are preferably anodized, inside and out. Since anodize is an electrical insulator, electrical connections are made through the wires 372, rather than through the components themselves. This provides for more reliable electrical connections, reduces corrosion and corrosion related failures, and simplifies manufacture as masking during finishing of metal components is eliminated.

Figure 36:
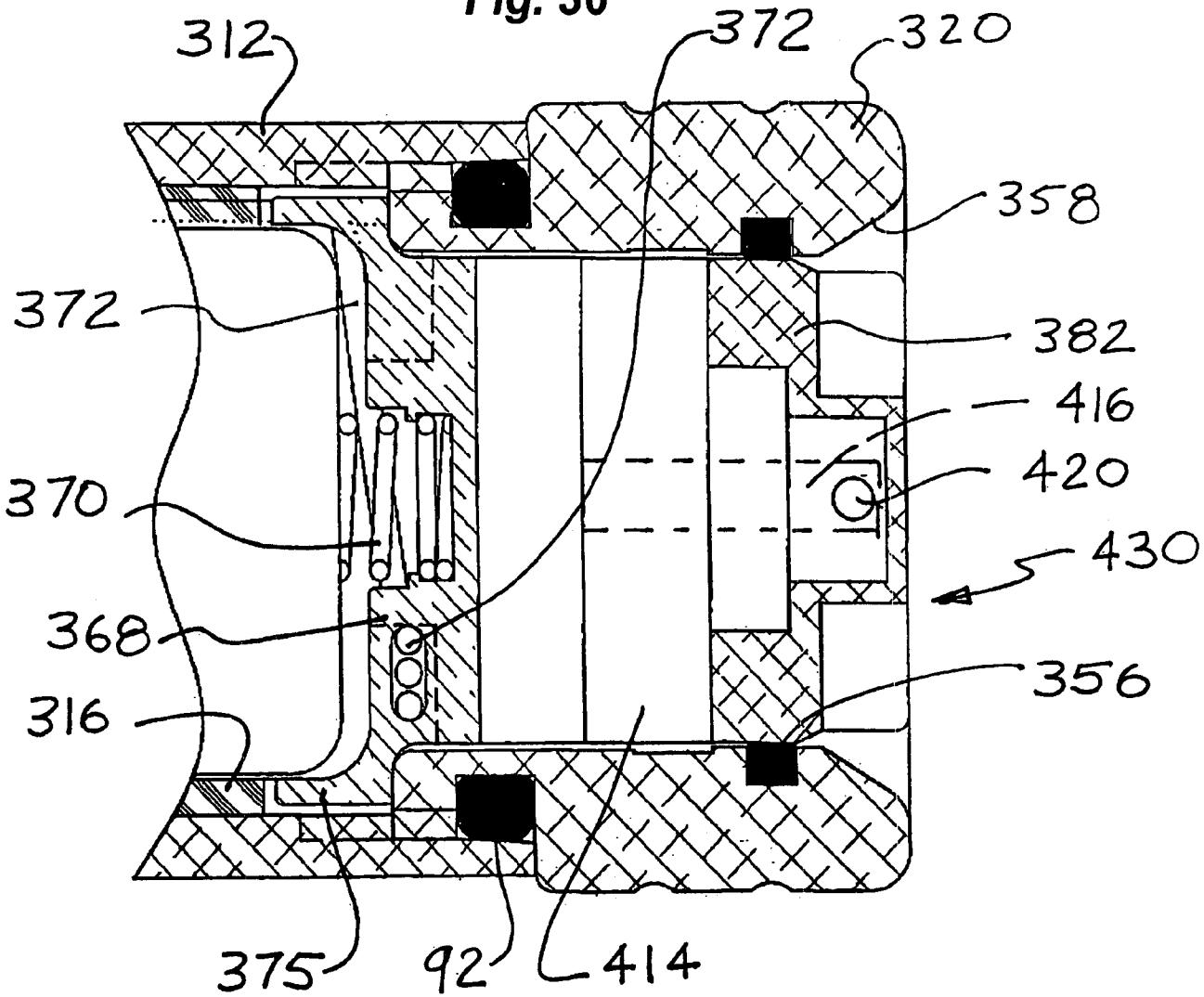
FIG. 36 is an enlarged partial section view of an alternative embodiment of the flashlight shown in FIG. 21.
Figure 40:
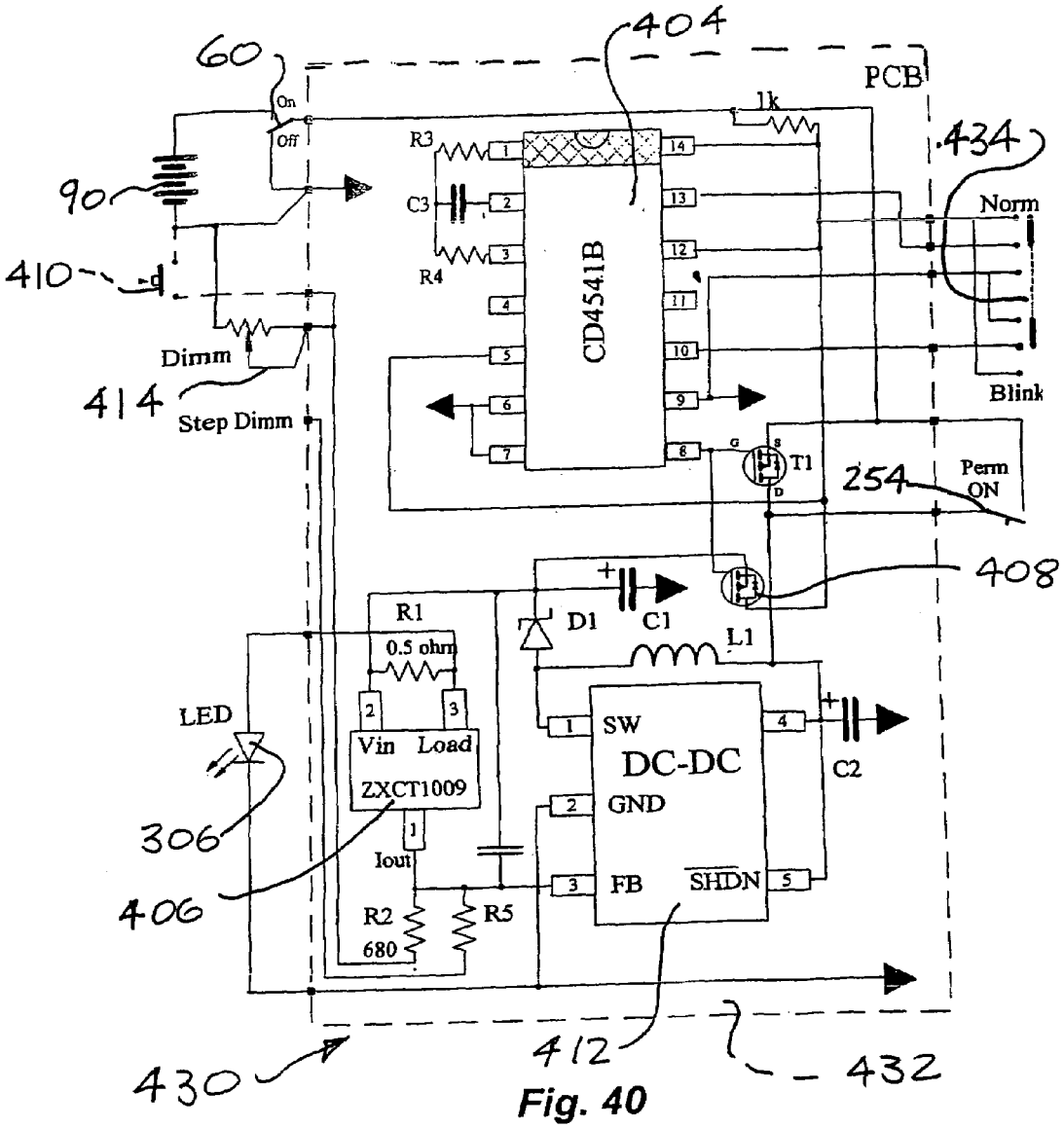
FIG. 40 is a schematic diagram of alternative circuitry for use in the flashlight shown in FIG. 1 or 21.

Turning to FIGS. 36 and 40, in an alternative flashlight end design 430, a pivotable or rotatable end knob 382 is provided in place of the push button 350. As shown in FIGS. 37 and 38, the end knob 382 has finger tabs 384, to facilitate turning the end knob 382 with the user's fingers. The end knob 382 is mechanically connected to a variable resister 414 electrically connecting to the circuitry module 314 through the wire bundle 372. A pin 420 attaches the end knob 382 to the shaft 416 of the dimmer 414. The variable resistor is attached to the back surface of spring plate 368. The variable resister 414, as shown in FIG. 40, varies current flow through the LED 306, thereby acting as a dimmer to adjust brightness.

In the design shown in FIGS. 33 and 36, various styles and types of batteries may be used including single use batteries as well as rechargeable batteries. Preferably two or three batteries may be used, providing 3 volts or 4.5 volts. The batteries may be AAA, AA, C, D, or N cells, or other equivalent batteries. Of course, other types and numbers of batteries may also be used. To change the batteries, the end cap 320 is unscrewed from the rear housing 312. The end cap 320 rotates, while the end knob 382, variable resistor 414, spring plate 368, spring 370, wires 372 and sleeve 316 remain in place. The sleeve 316 is fixed against movement by friction, or optionally adhesives. The spring plate anti-rotation tabs 375 on the spring plate prevent rotation of the spring plate 368 as the end cap 320 is rotated. As the variable resistor 414 and the end knob 382 are attached to the spring plate 368, these components also remain in place. After the end cap 320 is unscrewed, the end cap, and the components 382, 414, 368 within the end cap, are pivoted (as a subassembly) out of the way, to change the batteries. Similarly, in the design shown in FIG. 33, the end cap rotates free of the internal components 350, 366, 368, 364, until the end cap 320 disengages from the screw threads on the rear housing 312. Then, the subassembly of the end cap and the internal components is moved to one side, to change the batteries. Since the push button 350 or end knob 382, and their associated electrical connections, stay with the end cap 320, the wire bundle 372 is provided with sufficient extra length and flexibility to allow the end cap 320 to be unscrewed and pivoted to one side, while batteries are changed.

Figure 41:
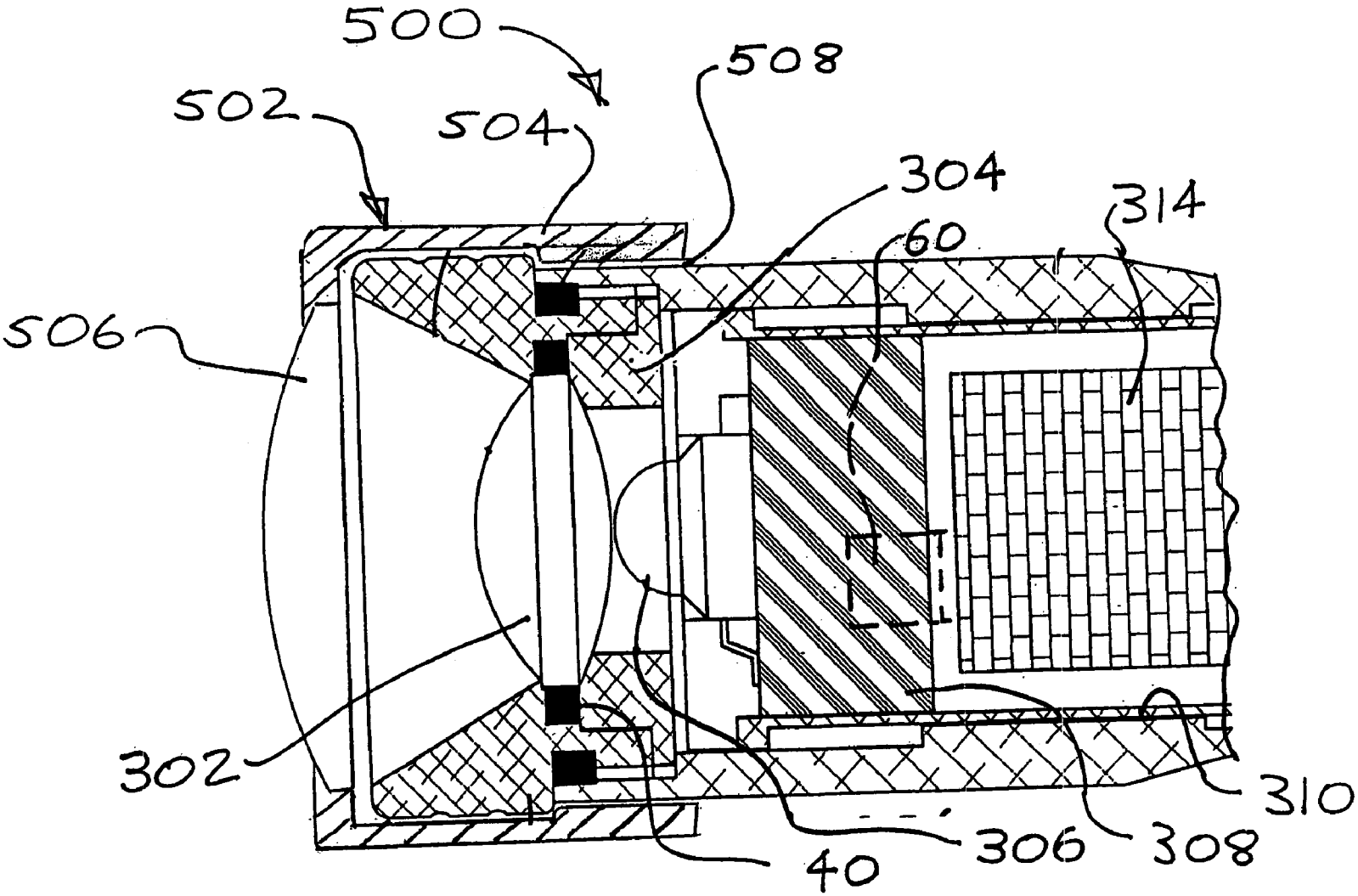
FIG. 41 shows an alternative flashlight design having two lenses.
Figure 42:
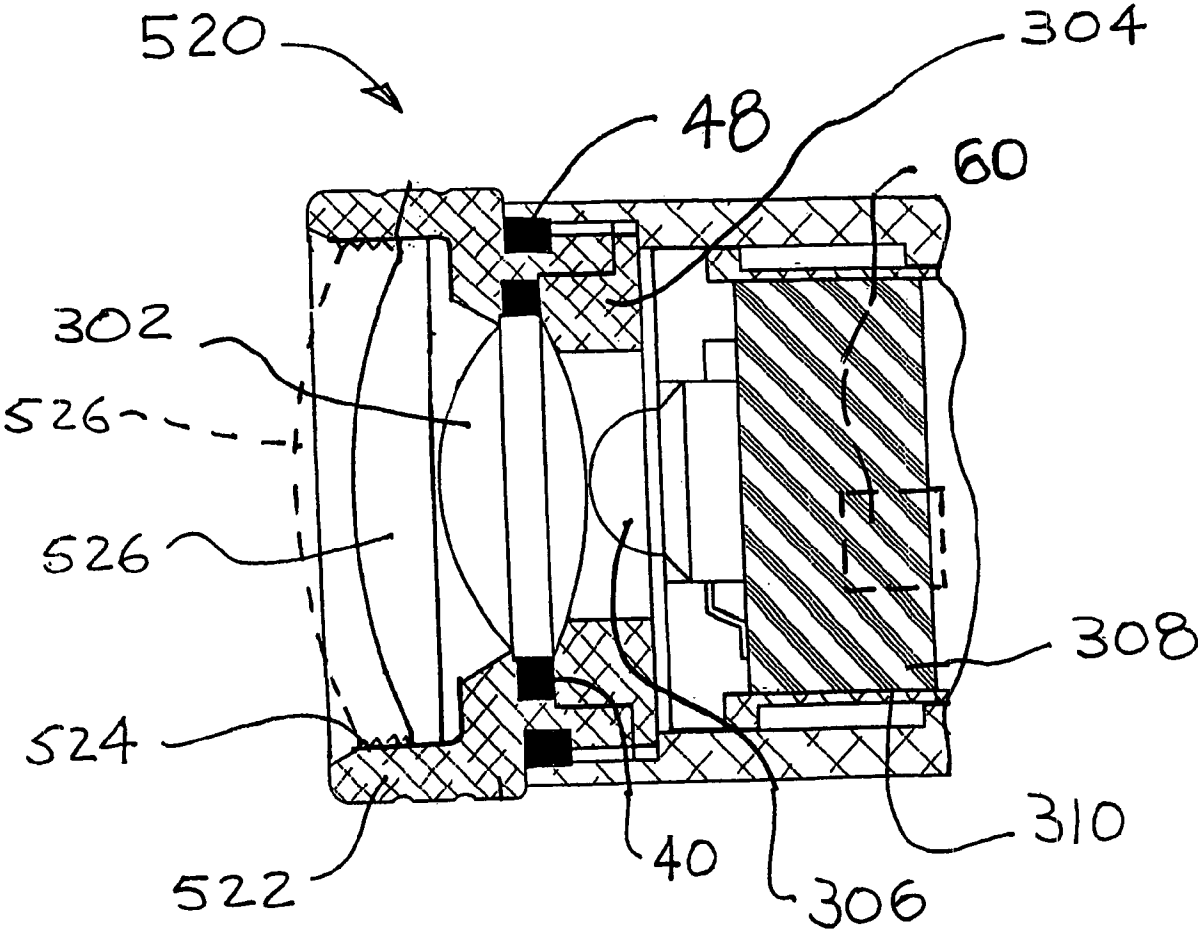
FIG. 42 also shows an alternative flashlight design having two lenses.

Referring to FIG. 40, in an alternate design, a blinking function may also be provided via the timer chip 404. A switch 434, which may be internal, or associated with either the pushbutton or end knob turning movements, switches the blinking function on and off. As shown in FIG. 41, in an alternative flashlight design 500, a second lens 506 is included in a removable accessory 502. The accessory 502 has arms or a cylindrical body 504 that fits over the front end cap 12. The arms or body 504 are flexible and can spring out to fit over and/or snap onto the front end cap. The position of the second lens 506 relative to the first lens 302 may be fixed, via the fit between the accessory and the front end cap. The second lens focuses the light into a more narrow beam, to provide a brighter spot at greater distances from the flashlight. If desired, the spacing between the first and second lens can be reduced by shortening the conical section of the front end cap. In another two lens design 520 shown in FIG. 42, a second lens 526 is contained within and is part of the flashlight. In this design, the second lens 526 is mounted in the front end cap 522. The second lens 526 may be fixed in position relative to the first lens 302, or it may be moveable or adjustable via screw threads 524 or a sliding adjustment. Moving the second lens 526 relative to the first lens 302 changes the focus characteristics, as may be desired.

Figure 43:
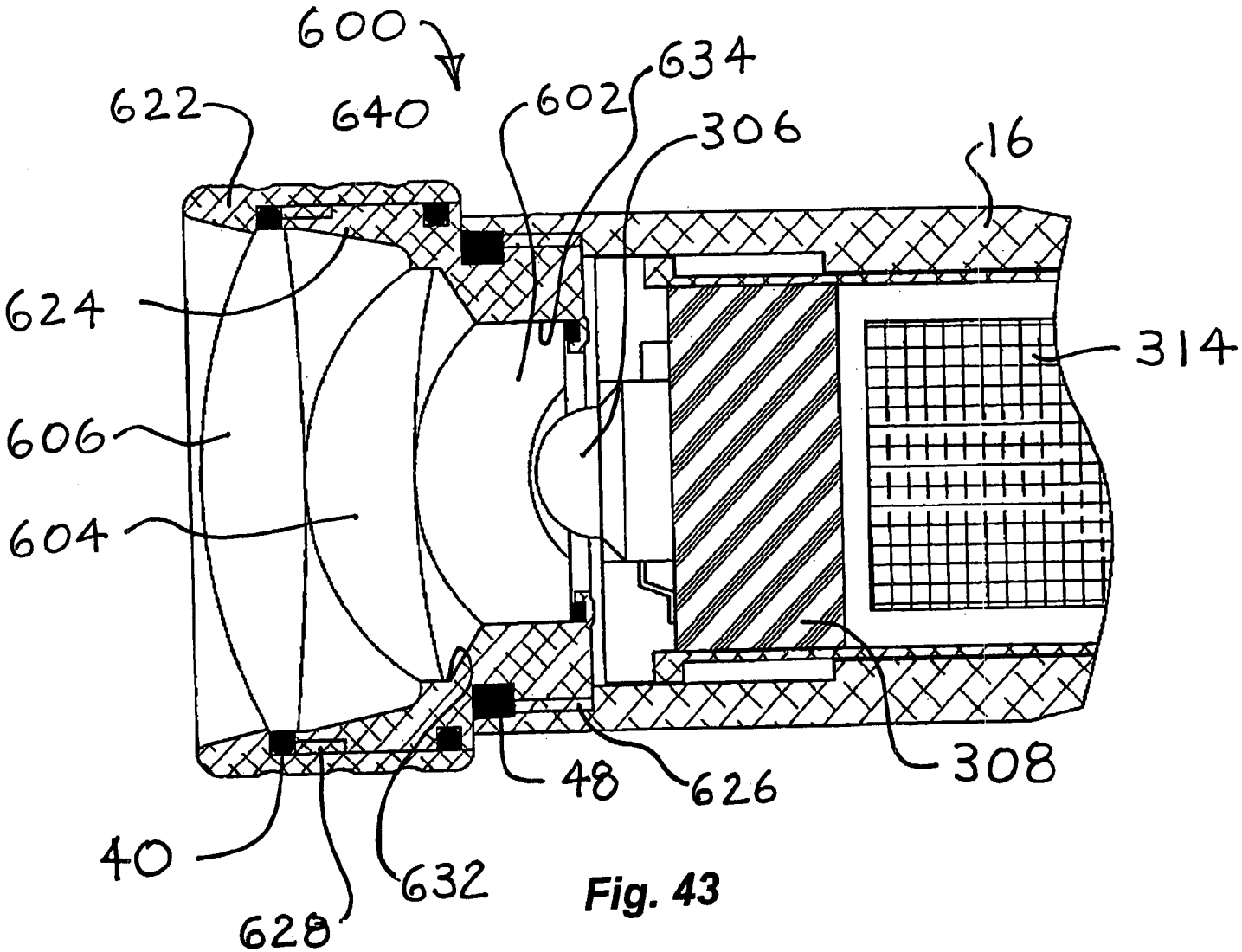
FIG. 43 is a section view of another alternative design having a three lens system.
Figure 44:
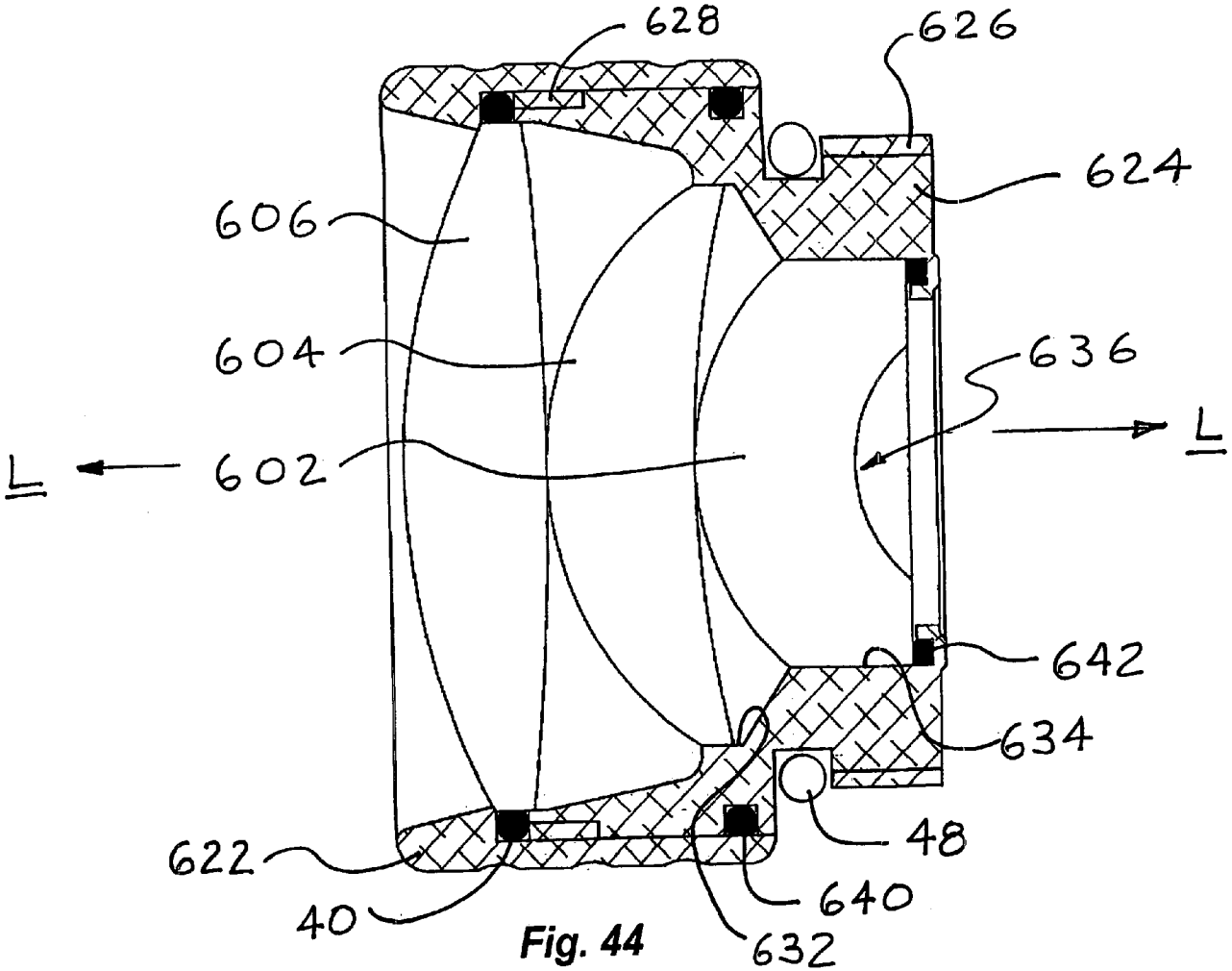
FIG. 44 is an enlarged view of the lenses in the lens holder, as shown in FIG. 43.
Figure 45:
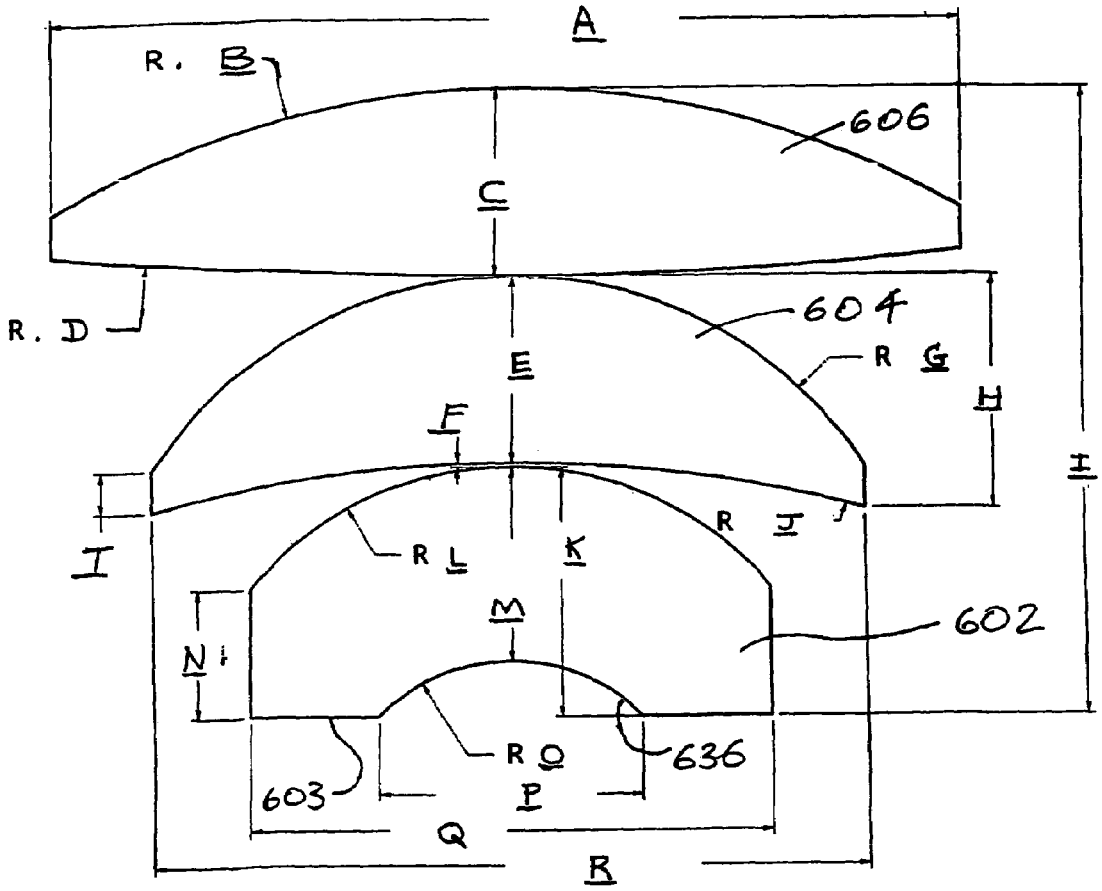
FIG. 45 is an enlarged view of the lenses shown in FIG. 44.

FIGS. 43, 44 and 45 shown a design having three lenses. Except for the differences in the lenses and lens holder, as described below, the design in FIGS. 43–45 is preferably the same as in the flashlight shown in FIGS. 1–5, 21, 41, or 42. The lens holder 624 is attached to the front end of the front housing section 16 via lens holder screw threads 626. An inner or first lens 602 is secured within an inner lens bore or seat 634 in the lens holder. A second or middle lens 604 is similarly secured within a second lens bore or seat 632 in the lens holder 624. An end cap 622 is attached to the lens holder 624 via end cap screw threads 628. A third or outer lens 606 is secured or clamped between the front end or rim 625 of the lens holder 624, and a step or ledge 630 on the end cap 622. An O-ring 40 provides a seal around the third lens 606. Adhesives may optionally be used to hold the lenses in position.

The first lens 602 is axially positioned (front to back along the axis L—L in FIG. 44) via a shoulder 640 at the back end of the inner lens bore or seat 634. The second lens 604 is similarly positioned via a shoulder 642. All three lenses are concentric with each other and centered radially on the axis L—L. The second lens 604 is spaced slightly apart (e.g., 0.1 mm at the centerline or axis L—L). The third lens 606 preferably contacts the second lens 604 on the centerline.

The relative shapes and sizes of the lenses are shown in the drawings. The first lens 602 has a rear recess 636. As shown in FIG. 602, the LED 306 or other light source is positioned within the rear recess 636. As with the flashlight shown in e.g., FIG. 4, 21 or 41, the spacing between the LED 306 and the lenses can be changed, to focus the emitted light beam, by turning the front housing section relative to the rear housing section. The lenses are fixed in position relative to each other. The lenses move together, as a unit, relative to the LED or other light source, as the front housing section, which supports the lenses, moves axially relative to the rear housing section, which supports the light source. Of course, other techniques may also be used to change the spacing between the light source and the lenses. For example, the light source, or the lenses, or both can be moved e.g., via screw threads, cams, sliding elements, motors, gears or rack and pinion, springs, detents, or equivalent mechanical elements, to adjust focusing.

Since LED's in general radiate light over a wide angle (for example 110 degrees), the emitted light must be condensed or focused, to create a bright and more collimated beam. Locating the LED 306 within the recess helps focus the light into a narrow and intense beam, with an efficient and compact design. In the design shown in FIGS. 43–45, light from the LED 306 can be focused via the lenses into a 200–250 mm spot at a distance of 6 meters.

The lenses 602, 604 and 606 are preferably coated glass, to improve efficiency. The lenses may be machined or cast. The first lens 602 is preferably a piano-convex lens, except at the recess where it has a concave-convex geometry. The second lens 604 is preferably a concave-convex lens. The third lens 606 is preferably a non-symmetric convex lens. Preferred dimensions for the lenses, as shown in FIG. 45, are listed below. Of course, other dimensions may also be used. In addition, for some designs, using additional lenses, i.e., a four lens, or a five-lens system, may be advantageous.

| Dimension | Preferred Nominal (mm) |
|---|---|
| A | 21 |
| B(radius) | 20 |
| C | 4.4 |
| D | 94 |
| E | 4.5 |
| F | 0.1 |
| G(radius) | 9.4 |
| H | 5.7 |
| I | 15 |
| J(radius) | 30 |
| K | 6 |
| L(radius) | 7.4 |
| M | 4.7 |
| N | 3.1 |
| O(radius) | 3.9 |
| P | 5.9 |
| Q | 11.8 |
| R | 16.1 |
| T | 1 |

Figure 46:
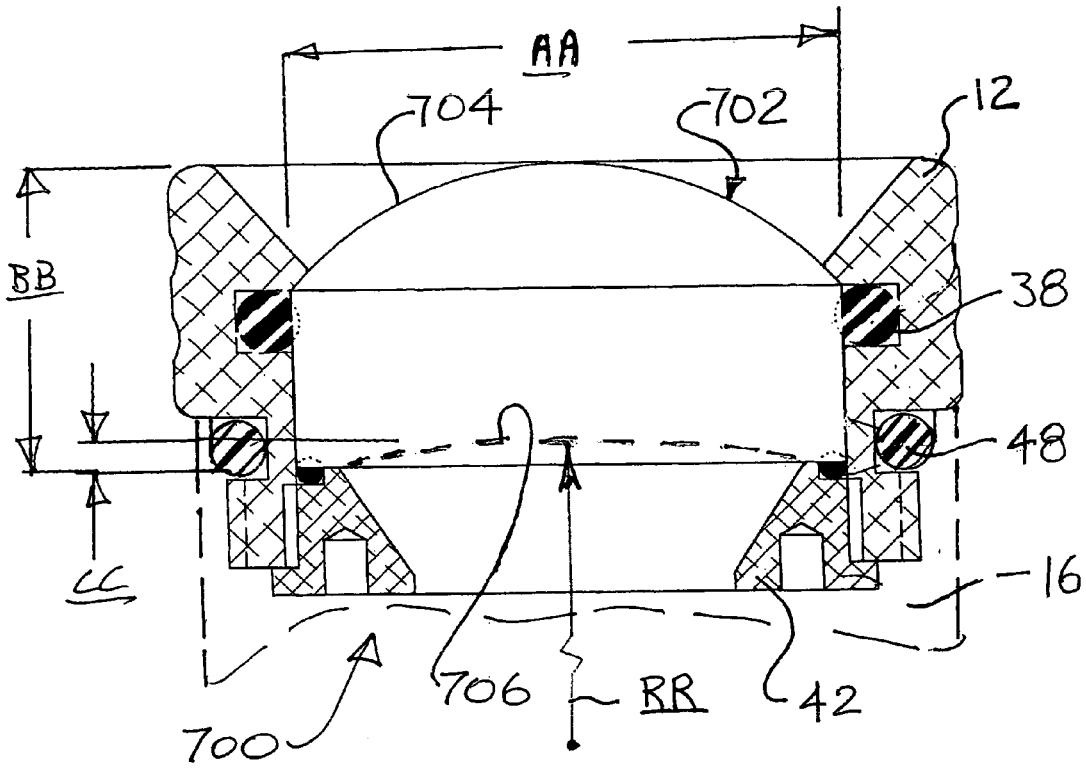
FIG. 46 is an alternative flashlight design having a convexoconcave lens.

As shown in FIG. 46, in another alternative design 700 a single convexoconcave lens 702 is used. The back surface 706 of the lens 702 is concave and the front surface 704 of the lens 702 is convex. The lens thickness BB ranges from about 0.25–0.40 inches, and is about 0.33 inches in the specific design shown. The diameter AA of the lens 702 ranges fit the flashlight size or other parameter, and will typically be about 0.3–3.0 inches, (with AA about 0.4–0.8 or 0.6 inches in the design of FIG. 46). The radius of curvature of the concave rear surface of the lens 702 ranges from about 0.3–3 inches, and is typically about 1–3 or 1.5–2.5 inches. This design, using a single convexoconcave lens 702 (with a rear surface radius of about e.g., 2.0 inches) works well over shorter ranges of about 0–50 feet. The lens shown in FIG. 46 may also be used in lens combinations, for example as shown in FIG. 45, for use over longer ranges of up to 75 or 100 feet.

Figure 47:
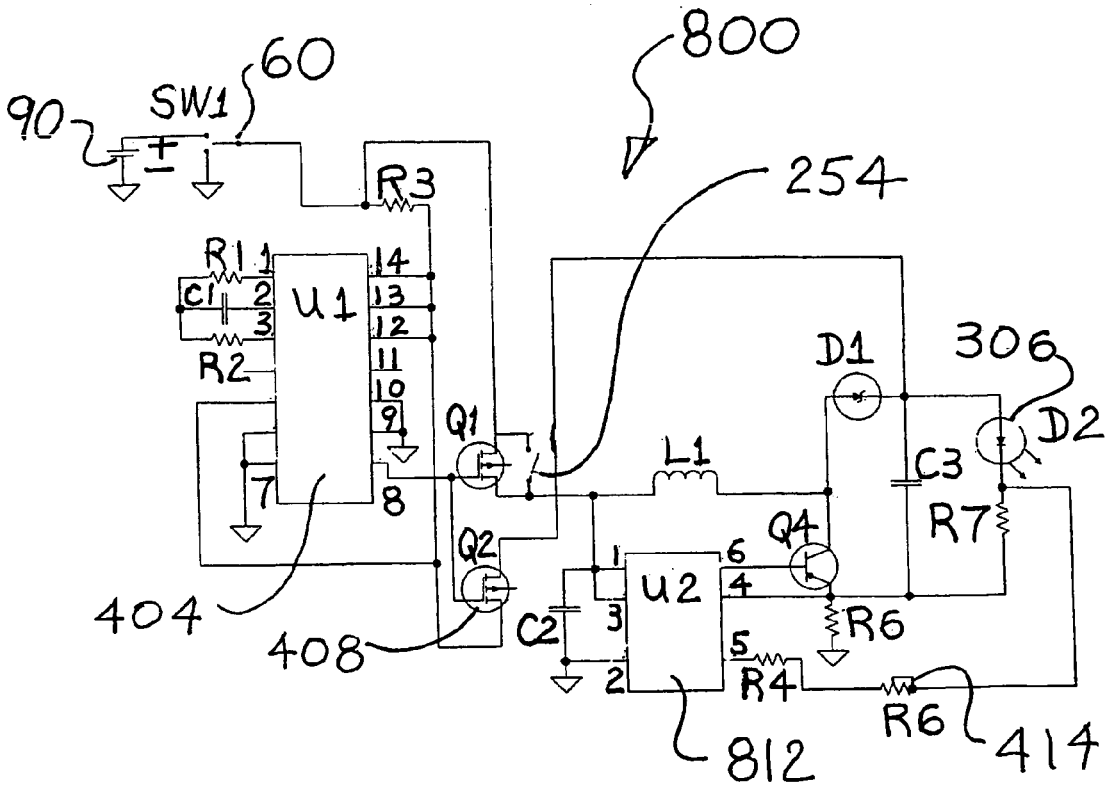
FIG. 47 is a schematic diagram of alternative circuitry for use in the flashlight shown in FIG. 1 or 21.

FIG. 47 shows an alternative flashlight circuit 800 for use in place of the circuit 400 shown in FIG. 39 or 40. The circuit 800 uses a boost converter 812 (such as a Zetex ZXSC400) to maintain current flow through the LED 306, while the voltage from the battery 90 decreases over time. The combination of the boost converter 812 and the transistor Q4 allows for very low feedback voltage, resulting in lower losses, while still accurately maintaining current flow. The circuit shown in FIG. 47 can be easily adapted to operate with a 1, 3, or 5 watt LED 306 (or to other values as well), by simply changing the values of L1 and changing Q4. The operating voltage supply range is also improved, with the circuit 800 able to operate with a battery voltage down to about as low as 1.8 volts. The efficiency of the circuit is also increased, thereby increasing the useful life of the batteries 90.

Figure 48:
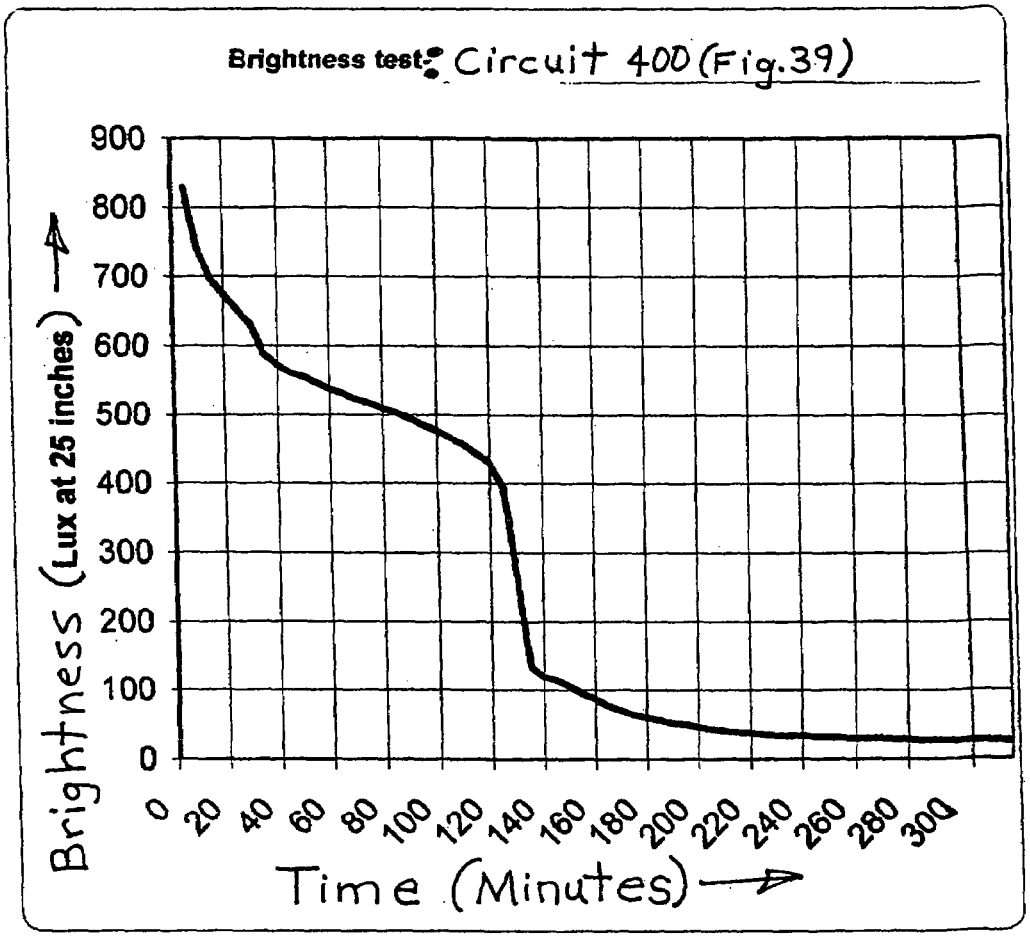
FIG. 48 is a graph of the performance of the flashlight shown in FIG. 43 using the circuitry shown in FIG. 39.
Figure 49:
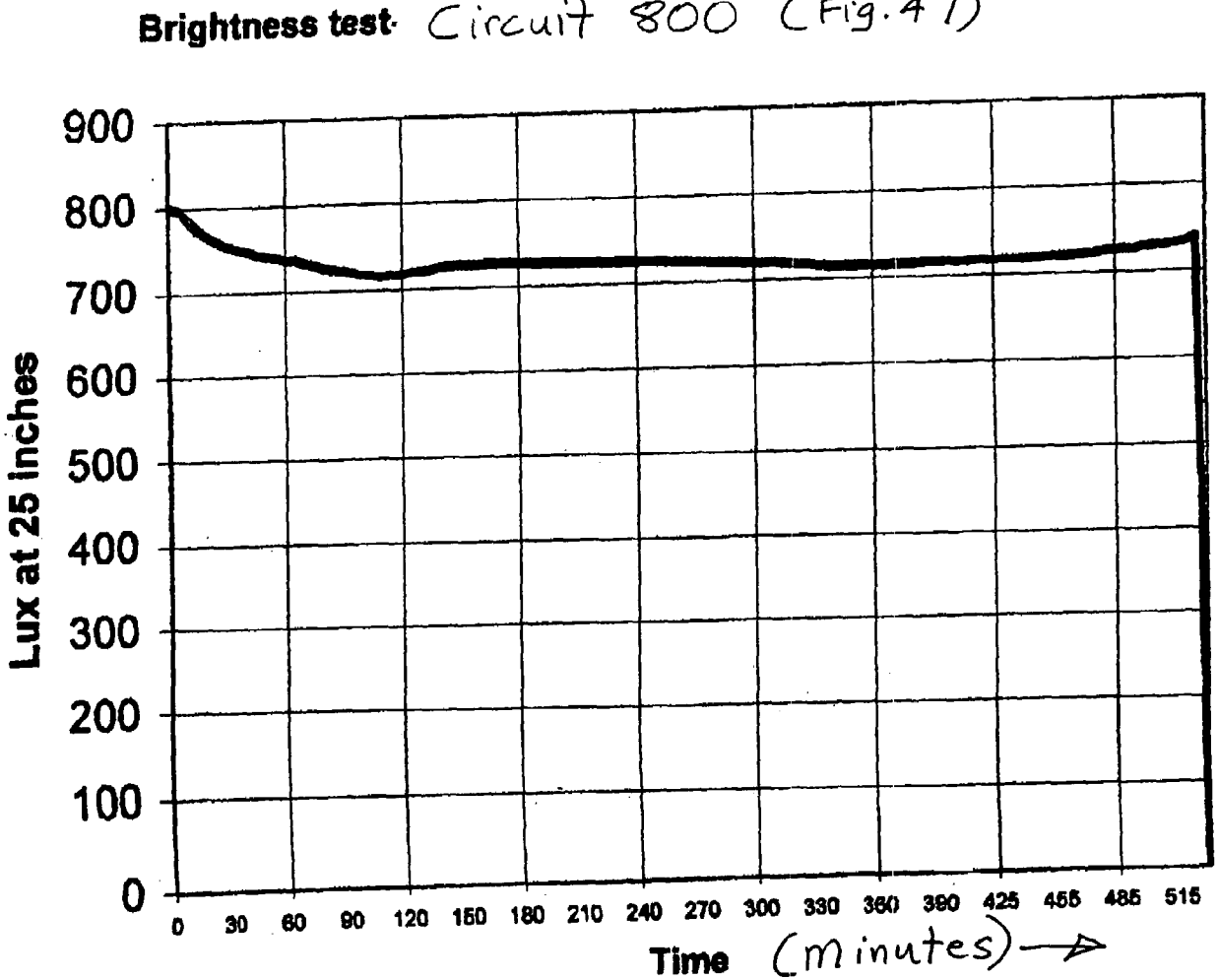
FIG. 49 is a graph of the performance of the flashlight shown in FIG. 43 using the circuitry shown in FIG. 47.

FIG. 48 is a graph showing performance of a flashlight 600 as shown in FIG. 43, having a 1 W LED powered by two AAA cells, using the circuit 400 shown in FIG. 39. FIG. 49 is a graph of performance of the same flashlight, using the circuit 800 shown in FIG. 47. In each case, the flashlight was adjusted using the dimmer 414 to provide an initial brightness of 800 Lux at 25 inches (about 18% of maximum brightness). In each case, brightness measurements were taken every 5 minutes. With the circuit 400, brightness dropped to about 50% after about 130 minutes, and dropped below 100 Lux after about 170 minutes. With the circuit 800, as shown in FIG. 49, the brightness remained above 700 Lux for over 500 minutes.

Figures 50, 51, 52:
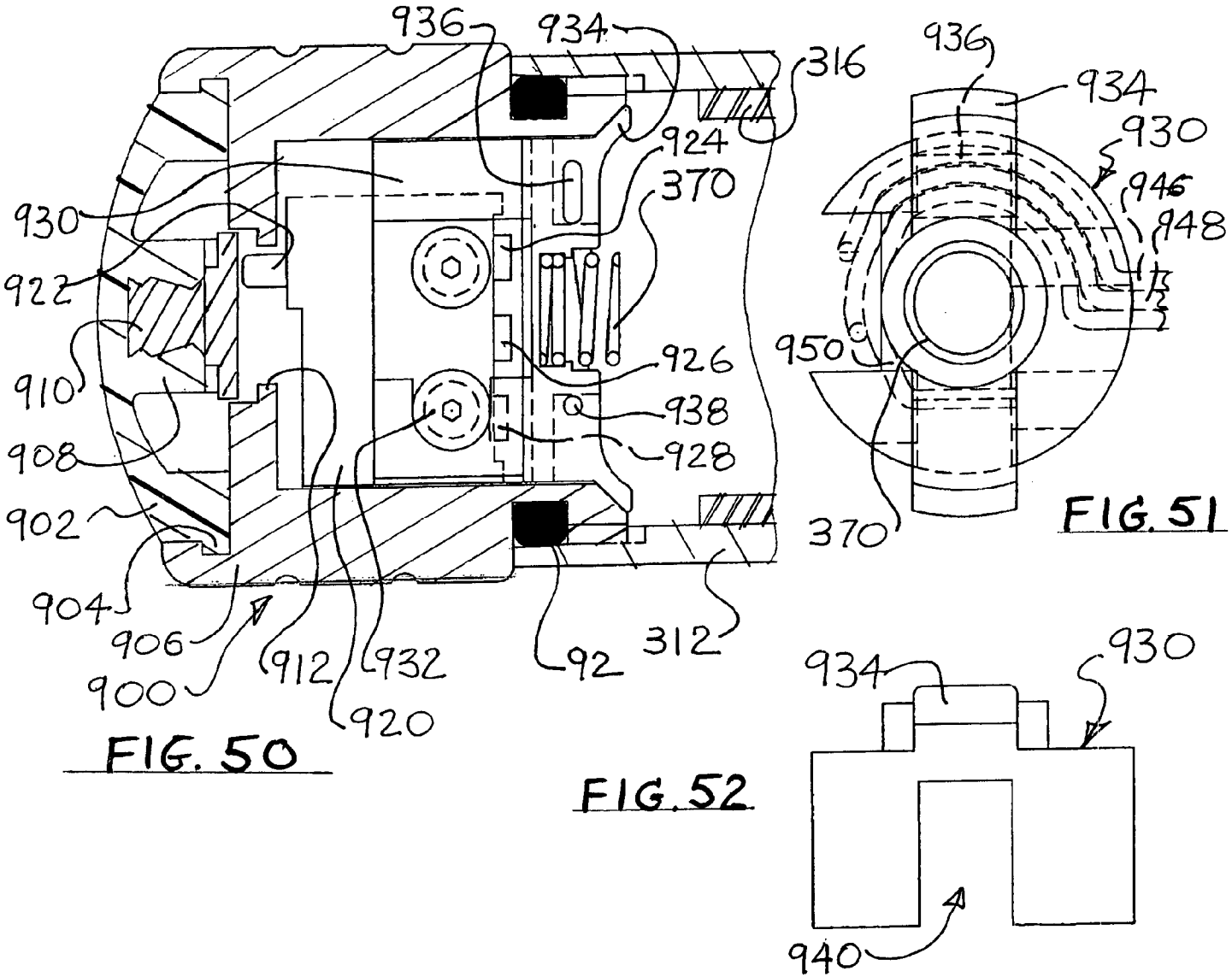
FIG. 50 is a partial section view of the back end of another flashlight.
FIG. 51 is an end view of the flashlight shown in FIG. 50.
FIG. 52 is side elevation view of the switch holder shown in FIGS. 50 and 51.

FIGS. 50–52 show another flashlight 900 having a momentary bright feature. Except for the description below, the flashlight 900 may be the same as the other designs described above. In comparison to the flashlight shown in FIGS. 21–36, the flashlight 900 uses a momentary bright microswitch 920, instead of the variable resistor 414. Consequently, rather than a variable dimmer function, the flashlight 900 provides a momentary bright function, when the switch 920 is closed.

Referring to FIG. 50, a rubber end seal 902 has a lip or ring 904 held within a slot or groove in an end cap 906. The end seal seals the back end of the flashlight. The end seal 902 is advantageously precision molded and makes an interference fit with the end cap. A plunger 910 is secured into a center post 908 of the end seal 902. A shoulder 912 on the end cap 906 limits inward movement of the plunger 910.

Turning now also to FIGS. 51 and 52, the switch 920 is secured within a slot 940 of a switch holder 930 via screws 932. The switch holder 930 fits within the end cap 906 with a slight clearance. This allows the end cap to be turned without turning the switch holder 930. A switch button 922 on the switch 920 is adjacent or in contact with the plunger 910, as shown in FIG. 50. Tabs 934 on the switch holder 930 help to hold the switch holder 930 in position within the end cap 906. First, second and third wires 946, 948 and 950 extend around the switch holder 930 and through a slot 936 in the switch holder, similar to the design in FIGS. 21–36. The first and second wires 946 and 948 connect to first and second contacts 924 and 926, respectively, on the switch 920. The third wire 950 passes through a hole 938 in the switch holder 930, and is soldered to the switch holder 930 as a ground wire. As shown in FIG. 51, this provides a neat and compact wiring harness, so that the batteries can be quickly and easily changed.

The switch 920 is normally open. In this state, a current limiting resistor, such as R4 in FIG. 19 or 20, or R7 in FIG. 47, is in series with the LED. Consequently, current flow through the LED is limited. This provides for extended battery life, in a normal use mode. For example, if the flashlight 900 uses two 1.5 volt AAA cells, and a 1 watt LED, current flow through the LED in the normal use mode may be e.g., 80–160, or 100–140, and nominally 120 mA in this design, as determined by the resistance of the LED and the rest of the circuit. Under these conditions, the batteries can be expected to nominally last for about 6 hours, before light output drops below a specified level.

The momentary bright feature is used by pressing in on the end seal 902. As the user pushes the end seal 902 in (with a thumb or finger), the plunger 910 pushes on the switch button 922. This closes the switch, shorting the first contact and wire to the second contact and wire. The current limiting resistor (e.g., R4 or R7) is also shorted or bypassed. Consequently, the resistance of the circuit connecting the batteries to the LED drops, and current flow increases. The increase in current increases the light output from the LED. With the batteries and LED in the example above, current increases from e.g., 120 mA, to about e.g., 500–750 mA, and nominally 640 mA, in this particular design. This increases the brightness of the LED by about 40–50%. However, battery life is proportionally reduced, for example, to about 1–2 hours. When the end seal 902 is released, the switch switches back to normal mode, as the switch button 922 and the center post 908 of the end seal 902 are resiliently or spring biased outwardly, away from the switch 920. Hence, the flashlight 900 remains in the bright mode, only when the end seal 902 is pressed in. This largely prevents inadvertently leaving the flashlight in the bright mode, and prematurely draining the batteries. In addition, when the front or on/off switch 60 is in the off position, the momentary bright switch 920 cannot cause the LED to turn on, or to remain on. If the switch 60 is off or open, movement of the switch button, intentional or unintentional, will not cause the flashlight 900 to turn on. The risk of draining the batteries by inadvertently having the end seal pressed in, is accordingly greatly reduced.

The momentary bright mode or feature is useful when a brighter light is wanted for a relatively short time interval, for example, for reading, viewing or inspecting over a short distance, or for better viewing of more distant objects under dim or no light conditions. The momentary bright mode, as described above, may be used in any of the flashlights described above, alone, or in combination with other features. For example, if desired, the momentary bright mode components and feature can be included in the flashlight shown in FIGS. 21–36, resulting in a flashlight having both dimming feature and a momentary bright feature. Of course, one or more other features described above, such as automatic off, blink, or permanent on mode, may also be included.

Referring to FIG. 50, to change the batteries, the end cap 906 is un-screwed. The switch holder 930 remains substantially in place, as the end cap 906 turns. The end cap is then removed from the rear section 312 and moved to one side. The switch holder 930 is then pulled back and out of the rear section. The wires 946, 948 and 950 have sufficient slack for this purpose. The spent batteries are replaced, and the flashlight 900 re-assembled.

While embodiments and applications of the present invention have been shown and described, it will be apparent to one skilled in the art that other modifications are possible without departing from the inventive concepts herein. Importantly, many of the steps detailed above may be performed in a different order than that which is described. For example, in the time-based automatic lock mode, a user may set the specified duration of phone non-operation required to trigger the lock mode before setting the access password. The invention, therefore, is not to be restricted except by the following claims and their equivalents.

The invention claimed is:

1. A flashlight comprising:

an LED;

a power source connected to the LED via a circuit;

an on/off switch in the circuit;

a momentary bright switch in the circuit, for momentarily increasing current from the power source to the LED; and with the LED at a front end of the flashlight, and with the momentary bright switch at a back end of the flashlight, and with the momentary bright switch normally open, so that a first amount of current is provided to the LED, and with the momentary bright switch switchable to a closed position via continuous exertion of force, so that a second amount of current, greater that the first amount, is provided to the LED.

2. The flashlight of claim 1 further comprising an end seal at the back end of the flashlight, and a plunger associated with the end seal, with the plunger moveable to actuate the momentary bright switch.

3. A flashlight comprising:

an LED;

a power source connected to the LED via a circuit;

an on/off switch in the circuit; and a momentary bright switch in the circuit, for momentarily increasing current from the power source to the LED, with the circuit comprising a resistor in series with the LED, when the momentary bright switch is open, and with the resistor shorted by closing the momentary bright switch, to increase current to the LED.

4. The flashlight of claim 3 with the LED at a front end of the flashlight, and with the momentary bright switch at a back end of the flashlight, and with the momentary bright switch normally open, so that a first amount of current is provided to the LED, and with the momentary bright switch switchable to a closed position via continuous exertion of force, so that a second amount of current, greater that the first amount, is provided to the LED.

5. The flashlight of claim 4 further comprising an end seal at the back end of the flashlight, and a plunger associated with the end seal, with the plunger moveable to actuate the momentary bright switch.

6. The flashlight of claim 3 further comprising an end seal at a back end of the flashlight, and a plunger associated with the end seal, with the plunger moveable to actuate the momentary bright switch.

* * * * *